US008905603B2

(12) United States Patent
Trewin

(10) Patent No.: US 8,905,603 B2
(45) Date of Patent: Dec. 9, 2014

(54) COUPLING AND METHOD FOR USE WITH A LAMP FITTING

(75) Inventor: Christopher Scott Trewin, Wynyard (AU)

(73) Assignee: 300K Enterprises Pty Ltd, Wynyard, Tasmania (AU)

( * ) Notice: Subject to any disclaimer, the term of this patent is extended or adjusted under 35 U.S.C. 154(b) by 428 days.

(21) Appl. No.: 12/998,007

(22) PCT Filed: Aug. 31, 2009

(86) PCT No.: PCT/AU2009/001121

§ 371 (c)(1),
(2), (4) Date: Mar. 7, 2011

(87) PCT Pub. No.: WO2010/028423

PCT Pub. Date: Mar. 18, 2010

(65) Prior Publication Data

US 2011/0157903 A1 Jun. 30, 2011

(30) Foreign Application Priority Data

Sep. 9, 2008 (AU) ..... 2008904670
Jul. 20, 2009 (AU) ..... 2009903376

(51) Int. Cl.

| | |
|---|---|
| ***F21V 19/02*** | (2006.01) |
| ***F21S 8/08*** | (2006.01) |
| ***F21V 23/06*** | (2006.01) |
| ***F21V 25/02*** | (2006.01) |
| ***F21V 21/116*** | (2006.01) |
| *F21Y 101/02* | (2006.01) |
| *F21Y 103/00* | (2006.01) |
| *H01R 33/94* | (2006.01) |

(52) U.S. Cl.

CPC ..... *F21V 23/06* (2013.01); *F21Y 2101/02* (2013.01); *F21Y 2103/003* (2013.01); *F21V 25/02* (2013.01); *F21V 21/116* (2013.01); *H01R 33/94* (2013.01)

USPC ..... 362/418; 362/267; 362/430

(58) Field of Classification Search

CPC ..... F21V 21/116; F21V 23/06; F21V 25/02; F21V 2101/02; H01R 33/94

USPC ..... 362/267, 382, 418, 419, 430

See application file for complete search history.

(56) References Cited

U.S. PATENT DOCUMENTS 3,871,732 A * 3/1975 Appleton ..... 439/356
4,437,054 A * 3/1984 Swift, Sr. ..... 324/508

(Continued)

FOREIGN PATENT DOCUMENTS

DE 11 42 963 B 1/1963
DE 39 05 089 8/1989

(Continued)

OTHER PUBLICATIONS

PCT International Search Report, PCT/AU2009/001121 dated Nov. 19, 2009.

(Continued)

*Primary Examiner* — John A Ward
(74) *Attorney, Agent, or Firm* — TraskBritt, P.C.

(57) ABSTRACT

The present invention provides a coupling and methods of use of the coupling. In one aspect the invention provides a coupling for use with a lamp fitting operated by a power supply, which coupling allows mounting/dismounting of the fitting without electrical isolation from the supply said coupling comprising: a) a mounting member having a first electrical connector element with shielded contact points connectable to the power supply, said member being suitable for fixing to a structure; and engageable with said mounting member; b) a holder member suitable for holding a lamp fitting said member having a second electrical connector element able conduct power to a lamp fitting; c) wherein engagement of the first and second members allows the first and second electrical connector elements to come into contact and disengagement allows electrical contact to be broken without exposure of the contact points.

20 Claims, 19 Drawing Sheets

(56) References Cited

U.S. PATENT DOCUMENTS

| | | | | | |
|---|---|---|---|---|---|
| 4,459,648 | A | * | 7/1984 | Ullman | 362/307 |
| 4,760,507 | A | * | 7/1988 | Lasker et al. | 362/239 |
| 5,264,997 | A | * | 11/1993 | Hutchisson et al. | 362/645 |
| 5,304,076 | A | | 4/1994 | Pelton et al. | |
| 5,334,032 | A | * | 8/1994 | Myers et al. | 439/140 |
| 5,600,280 | A | * | 2/1997 | Zhang | 331/57 |
| 6,893,144 | B2 | * | 5/2005 | Fan | 362/249.01 |
| 7,226,202 | B2 | * | 6/2007 | Chen et al. | 362/649 |
| 2006/0291220 | A1 | | 12/2006 | Chen | |

FOREIGN PATENT DOCUMENTS

| | | | |
|---|---|---|---|
| EP | 0 092 243 | A1 | 10/1983 |
| EP | 813354 | | 12/1997 |
| EP | 1 465 295 | A1 | 10/2004 |
| EP | 1 456 914 | B1 | 10/2007 |
| FR | 726 012 | A | 5/1932 |
| GB | 152709 | | 6/1919 |
| JP | 2001-297841 | | 10/2001 |
| RU | 2 287 213 | | 10/2002 |
| WO | 03/044906 | A1 | 5/2003 |
| WO | WO 2008/102181 | | 8/2008 |
| WO | WO 2010/028423 | A1 | 3/2010 |

OTHER PUBLICATIONS

PCT International Preliminary Report on Patentability, PCT/AU2009/001121 dated Aug. 12, 2010.

* cited by examiner

COUPLING AND METHOD FOR USE WITH A LAMP FITTING

PRIORITY CLAIM

This is a national phase entry under 35 U.S.C. §371 of International Patent Application PCT/AU2009/001121, filed Aug. 31, 2009, published in English as International Patent Publication WO 2010/028423 A1 on Mar. 18, 2010, which claims the benefit to Australian Patent Application Serial No. 2009903376, filed Jul. 20, 2009, and which claims the benefit of Australian Patent Application Serial No. 2008904670, filed Sep. 9, 2008, the entire disclosure of each of which is hereby incorporated herein by this reference.

TECHNICAL FIELD

The present invention relates to a coupling for use with lamp fittings such as those present at mining sites, parking lots, those used in street lighting, on freeways and in tunnels and also light fittings at industrial sites such as factories and the like.

BACKGROUND ART

Electric lamp fittings are in common use across the world in both domestic and industrial/commercial situations. A number of inventions have been made in relation to various lamp fittings and adapters therefore. For example inventions relating to adapters and lampshade carriers have been disclosed in European patent 813354, U.S. Pat. No. 5,304,076, WO 2008/102181 and GB 152709. Other inventions such as those disclosed in U.S. Pat. No. 3,871,732 and in US patent application 2006/0291220 have been directed at providing a more secure electrical contact and easier disconnection of a lamp in domestic light fittings.

While there have been a number of inventions directed towards improving domestic or small scale lamp fittings there are still unsatisfactory arrangements for maintenance and use of industrial or commercial lamp fittings.

Industrial lamp fittings are generally large and heavy and often mounted at height. For example those use as street lights generally comprise a light fitting in the form of a large housing which is secured to a spigot mounting at the end of the lamp pole. In this type of arrangement it is usual for the power connection to be wired directly to the light fitting which is then secured to the spigot mounting. Other means of mounting industrial or commercial light fittings include using a proprietary bracket where connection to the power source is provided through an entry point in the light fitting itself.

Due to the mounting arrangement of such lights, it is usual for maintenance to be carried out on site. That is, the light fitting is removed from the mounting or disassembled, maintenance work is carried out and the light fitting reassembled, if necessary and then the light fitting is secured back to the mounting in one operation. As specialised lifting equipment is generally required to gain access to such lights, these maintenance operations are carried out by the maintenance personnel on an elevated work platform, scissor lift, scaffold or other apparatus, which presents difficulties. Similar difficulties arise in any situation in which work in carried out on location rather than in a workshop environment, for example, lights mounted on elevated walkways and other elevated points for example in mine sites. Further difficulties include interference with traffic or any other operations being conducted in the vicinity of the light fitting. For example whilst working at height the area has to be barricaded and traffic and personnel restrictions are put in place. Access equipment is charged out by the hour making most simple tasks such as changing a light globe expensive.

The above references to and descriptions of prior proposals or products are not intended to be, and are not to be construed as, statement or admissions of the common general knowledge in the art.

The present invention attempts to overcome at least in part the aforementioned difficulties associated with performing maintenance on and replacing industrial lamp fittings.

DISCLOSURE OF THE INVENTION

In a first aspect the invention provides a coupling for use with a lamp fitting operated by a power supply, which coupling allows mounting/dismounting of the fitting without electrical isolation from the supply said coupling comprising:

a) a mounting member having a first electrical connector element with shielded contact points connectable to the power supply, said member being suitable for fixing to a structure; and engageable with said mounting member;

b) a holder member suitable for holding a lamp fitting said member having a second electrical connector element able conduct power to a lamp fitting;

c) wherein engagement of the first and second members allows the first and second electrical connector elements to come into contact and disengagement allows electrical contact to be broken without exposure of the contact points.

The term "lamp fitting" refers to an appliance which contains a lamp such as an incandescent, fluorescent, light emitting diode (LED) or other type of lamp and a lamp holder. The term may also include control equipment such as the ballast, the reflector, the diffuser and other components making up the fitting.

The term "a power supply" refers to an electrical power supply or source such as a mains supply, generator supply, battery supply or photovoltaic supply of electricity and includes an extra low voltage (ELV) supply.

The term "mounting and dismounting without electrical isolation" refers to the fact that the circuit on which the appliance is wired does not have to be disconnected or switched off to protect a worker when placing the fitting, replacing the fitting or otherwise handling or carrying out maintenance on the fitting.

The term "mounting member" refers to a component of suitable form and strength to support a lamp fitting.

The term "electrical connector element" refers to a conductive device for joining electrical circuits or parts of electrical circuits together. The term "with shielded electrical contact points" refers to contact points which are shrouded, inaccessible to, hidden or shielded from and/or touch proof to contact by a worker in routine circumstances. An advantage of the coupling of the present invention is that it utilizes an electrical connector which may be disconnected under full power load such as those used in domestic cordless devices including electric kettles. Generally the contact points will be a female part provided on the first electrical connector element. Electrical connectors sold under the trademarks Strix, Otto, Ketsol and the like are suitable for use as electrical connector elements in the present invention.

The term "connectable to the power supply" refers to the first connector element having the appropriate fittings to be wired to the power supply when the coupling is installed for use.

The term "suitable for fixing to" in relation to the mounting member means that it is suitable to be mounted on, secured to, or fixed to a structure, such as the spigot mounting on a lamp post or directly to a wall or building. The term "structure" refers to any structure or support on which a lamp fitting may be mounted such as a spigot in the case of street lights and lighting at mining sites and includes other structures such as planar structures as on buildings or walls where a lamp fitting may be mounted.

The term "engageable with" in relation to the members means that these are suitable for joining together, or engagement. Preferably the holder member is fixable or securable to the mounting member.

The term "a holder member suitable for holding a lamp fitting" means that the member is configured so as to hold or support the lamp fitting.

Similarly the term "able to conduct power to a lamp fitting" in relation to the second connector element means that the element has the appropriate fittings to allow current to flow to the lamp when the two connector elements come into contact.

The term "without exposure of the contact points" means that in the disengaged state the electrical contact points on the mounting member which, when is use are connected to the live supply and are energized, are not available for accidental contact with a worker's hands or fingers.

Preferably the coupling of the present invention is suitable for use with industrial and/or commercial lamp fittings. The term "industrial and/or commercial" refers to lamp fittings which are non-domestic in nature and are generally specialized bulky and/or heavy lamp fittings used in workplace, commercial and public settings generally as opposed to domestic or home-based situations. It encompasses mining sites, roadways, tunnels, parking lots including multi-storey parking lots, buildings such as factories, sporting facilities and venues other settings where industrial or commercial scale lighting is required.

In another aspect the present invention provides an improved method of mounting a lamp fitting operated by a power supply which improvement allows safe mounting/dismounting of the fitting without electrical isolation from the supply said method comprising: providing a) a mounting member having a first electrical connector element with shielded contact points connectable to the power supply; and b) a holder member engageable with said mounting member said holder member suitable for holding a lamp fitting, having a second electrical connector element able conduct power to the lamp fitting; wherein engagement of the first and second members allows the first and second electrical connector elements to come into contact and disengagement allows electrical contact to be broken without exposure of the contact points; and fixing said mounting member to a structure, connecting it to the power supply and engaging the holder member and lamp fitting with the mounting member.

In another aspect the invention provides an improved method of maintenance of light fittings operated by a power supply which method allows mounting/dismounting of the fittings without electrical isolation from the supply said method comprising: provision of light fittings associated with couplings each coupling comprising a) a mounting member having a first electrical connector element with shielded contact points connected to the power supply, said member being fixed to a structure; and engageable with said mounting member; b) a holder member holding a lamp fitting said member having a second electrical connector element able conduct power to the lamp fitting; c) wherein engagement of the first and second members allows the first and second electrical connector elements to come into contact and disengagement allows electrical contact to be broken without exposure of the contact points, the improvement comprising that replacement of light fittings can be carried out under full power load by disengaging said the holder member and replacing it with a fresh light fitting attached to a second holder member.

Preferably the lamp fitting used in the methods of the present invention are industrial and/or commercial lamp fittings.

In yet another aspect of the present invention there is provided a light fitting comprising a mounting and a light holder, wherein the mounting includes a first electrical connector, the light holder includes a second electrical connector and the light holder is securable to and removable from the mounting such that when the light holder is secured to the mounting, the first electrical connector contacts with the second electrical connector.

Preferably the mounting member and the holder member when engaged form a protective housing to help protect the connector elements from dust, dirt, moisture and the like. Even more preferably the housing is weather resistant. This means that the housing protects against the elements and is resistant to ingress of moisture and/or dust, dirt and the like. Still more preferably the housing is weather proof and can be hosed down with high pressure water jets to facilitate cleaning of the lamp fitting in situ.

Still more preferably the connector elements are engageable through 360° of rotation about a longitudinal axis of the housing. Even more preferably the members are of suitable dimensions such that engagement is provided by one part of one member sliding over another part of the other member. Preferably at least a part of one of the members comprises a substantially cylindrical sleeve wherein optionally the wall of the cylinder may be inclined or tapered. Still more preferably a part of the holder member slides over a part of the mounting member thus when slidingly engaged the coupling is able to support the weight of the light fitting enabling one-handed engagement and disengagement of the members. Still more preferably the one of members is suitably threaded and that members are fixed together by a complementary threaded annular element such as a locking ring.

Even more preferably the holder member and light fitting form an integrated unit suitable for coupling with the mounting member. Still more preferably the lamp is an energy efficient lamp such as LED.

Depending on the safety regulations in the country concerned, maintenance of a light fitting at an industrial or commercial site may require a hazard analysis to be carried out, a permit to be issued for the work and a certificate of compliance to be completed once the work has been carried out. Further most safety standards require that the light fitting the electrically isolated which in itself may present a difficulty. Many industrial sites do not keep accurate records and circuit identification is difficult. In addition for light fittings mounted at height it is necessary to access them with a scaffold, cherry picker or platform ladder. As some occupational health and safety standards require a worker to maintain three points of contact with a secure base when working from a stepladder or similar device, only one hand is available to perform tasks such as removal of a light fitting. For all these reasons, it is common on industrial and mine sites for example for 20% of the light fittings to be out of service at any one time.

The present invention is partly predicated on the recognition that interposing an electrical connector between a light fitting and its mounting enables many issues with lighting installation and maintenance to be addressed.

BRIEF DESCRIPTION OF THE DRAWINGS

FIGS. 16A to 16E show a left side view, a top view, a right side view, and an end view and a front view of the unitary fitting.

FIG. 17 B is a side view of the unitary fitting of FIG. 16 prior to engagement with the mounting member;

FIG. 19 B is a side cross-sectional view on the line A-A of the unitary fitting of FIG. 19A;

MODES OF CARRYING OUT THE INVENTION

Figure 1:
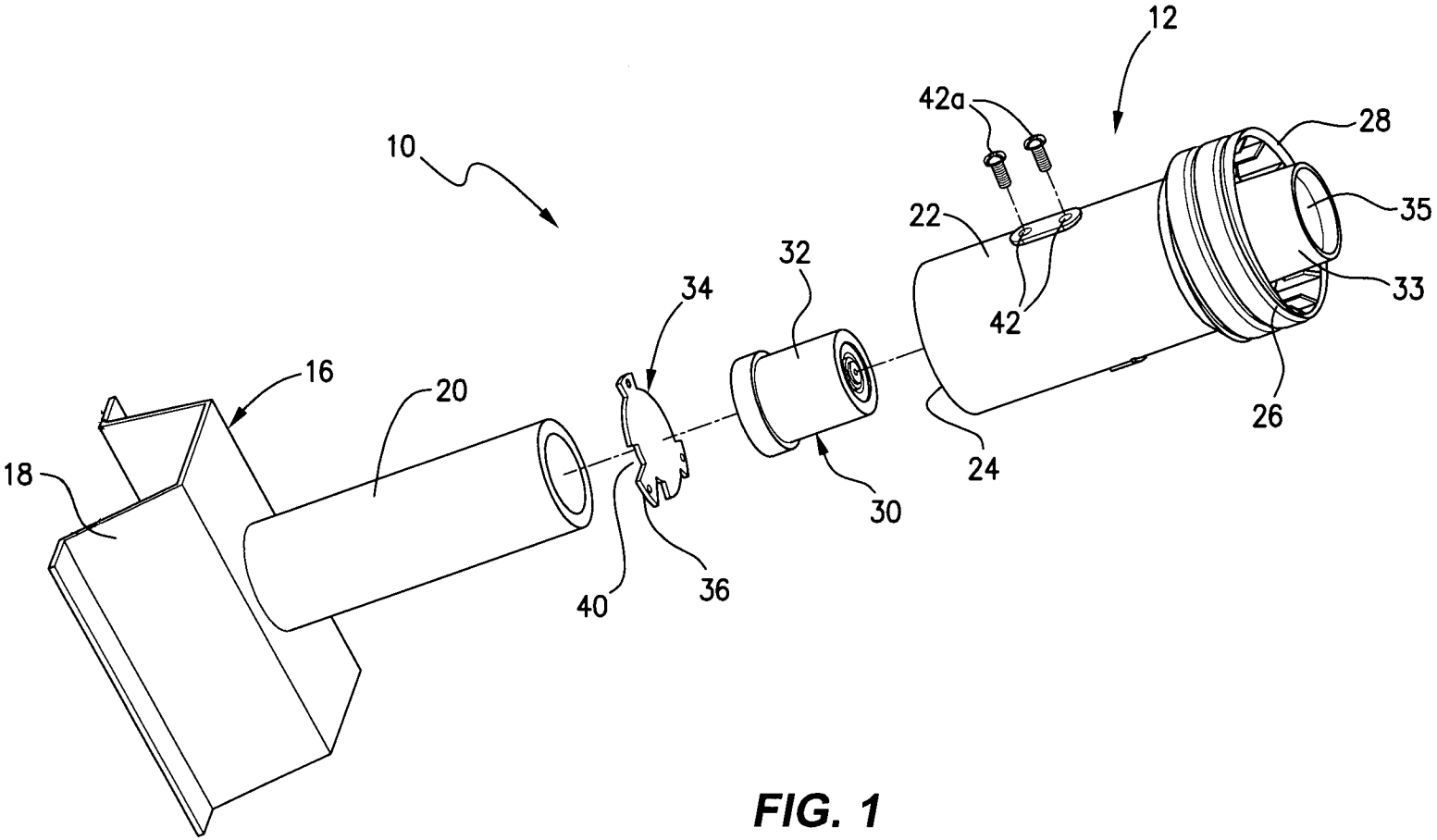
FIG. 1 is an exploded upper perspective view of the mounting member of the coupling of the present invention.
Figure 2:
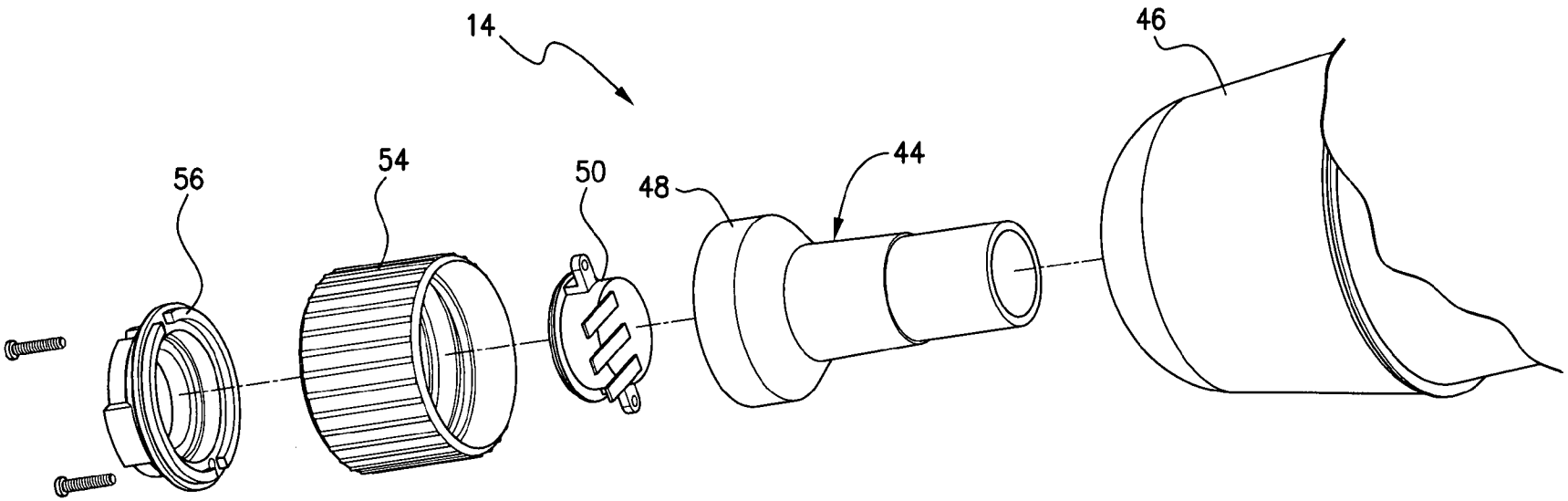
FIG. 2 is an exploded upper perspective view of the holder member of the coupling of the present invention.
Figure 3:
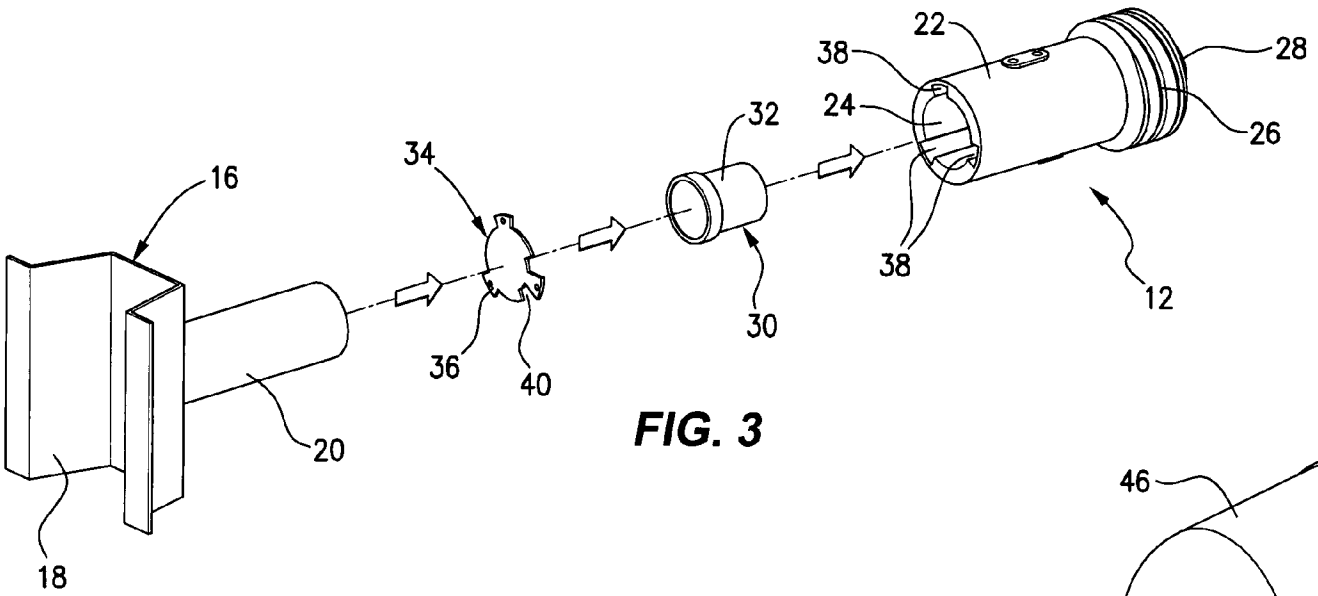
FIG. 3 is an exploded lower perspective view of the mounting member of FIG. 1.
Figure 4:
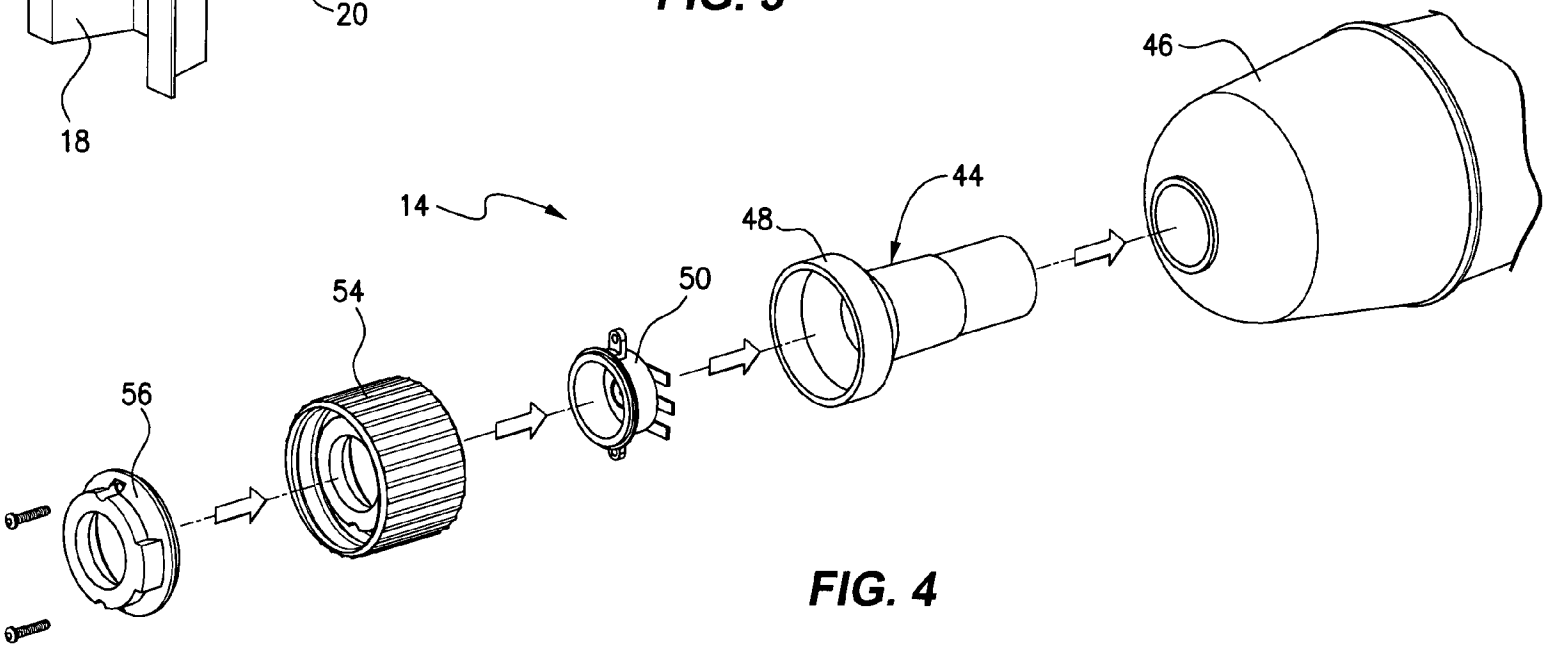
FIG. 4 is an exploded lower perspective view of the holder member.

Referring to FIGS. 1 to 6, there is shown a coupling 10 comprising mounting member in the form of mounting 12 and holder member in the form of a lamp holder 14. Together these members form housing 85.

Mounting 12 is adapted to be secured to an existing bracket 16 to which a standard light fitting would be mounted. In the embodiment shown, the bracket comprises a base 18 and a first cylindrical element, or spigot 20 extending from the base 18. The spigots in standard spigot mountings generally come in two sizes, 34 and 42 mm in diameter. In standard systems, a cylindrical member on a standard light fitting would be placed over spigot 20. The electrical wiring would pass through spigot 20 into the cylindrical member on a standard light fitting.

In the present invention mounting 12 comprises a cylindrical sleeve 22 of suitable diameter (such as 34 mm or 42 mm) having an open first end 24 and a male threaded connection 26 at a second opposite end 28 thereof. The mounting also includes a first electrical connector element in the form of first electrical connector 30. First electrical connector 30 is connectable to the power supply (not shown) in the bracket 16.

During assembly first electrical connector 30 is received within first end 24 of the cylindrical sleeve 22. A fixing plate 34 is then inserted into the first end 24 of the cylindrical sleeve 22 to hold first connector 30 is put in place. Fixing plate 34 comprises a generally circular plate having a plurality of tabs 36 around the periphery that engage with corresponding longitudinal grooves 38 on the interior surface of the sleeve 22. Fixing plate 34 also includes notches 40 for the cable supplying power to first electrical connector 30.

Figure 5:
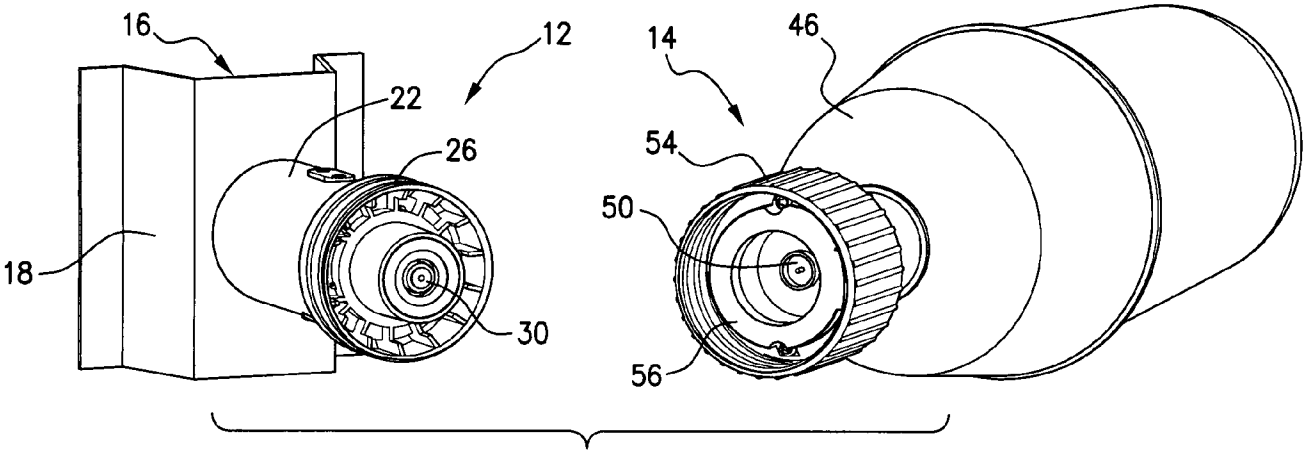
FIG. 5 is a perspective view of the coupling prior to engagement of the members, where the mounting member is mounted on a standard bracket.

The second end 28 of sleeve 22 includes a cylindrical projection 33 inside and coaxial with the threaded connection 26. The cylindrical projection 33 includes an open end 35. When inserted in the first end of sleeve 22, first electrical connector 30 is pushed to second end 28 so that it is housed by cylindrical projection 33 and the female portion 32 of first connector 30 is accessible via the open end 35 as shown in FIG. 5.

The cylindrical sleeve 22 includes apertures 42 in a side wall thereof for receiving fixing screws 42*a*. The fixing screws 42*a* engage in use with the first cylindrical element 20 of the bracket 16 to hold the mounting 12 in place.

The holder member in the form of lamp holder 14 has cylindrical element 44 with a first end suitable to engage with a lamp fitting (such as a 34 mm or 42 mm lamp fitting). Lamp holder 14 also includes a second electrical connector element in the form of second electrical connector 50 that is received within the widened opposite end 48 of the second cylindrical element 44. Second electrical connector 50 is suitably wired to enable it to be electrically connected to lamp fitting 46. It can be seen from FIG. 6 that when mounting 12 and lamp holder 14 are engaged, a housing is formed having a longitudinal axis about which the connector elements are rotatable through 360°. Thus first and second electrical connectors 30 and 50 can be rotated relative to each other when engaged while maintaining the electrical connection. This provides significant benefits when installing or replacing a lamp fitting because it is unnecessary to carefully angle or twist the members to gain electrical connection as may be required in some lighting systems.

The first and second electrical connector elements may comprise any suitable connectors which have shielded contact points and can be disconnected under full power load without electrical isolation of the lamp fitting. Connectors such as those used in cordless electric devices are suitable for example connectors sold as 360 degree Otter brand, Strix brand connectors including the P 72 model, Ketsol connectors and the like.

Lamp holder 14 also includes a threaded annular element in the form of a locking ring 54 and a securing means 56. The locking ring 54 includes an internal thread to engage with the threaded connection 28 on the sleeve 22. The locking ring 54 engages around the widened end 48 of the second cylindrical element 44 after the second electrical connector 50 has been placed in the second cylindrical element 44. Securing means 56 comprises a circular element that is received in the locking ring 54. Second electrical connector 50 is secured between securing means 56 and second cylindrical element 44 when the locking ring 54 is screwed up. The locking ring 54 is free to rotate relative to the rest of the light holder 14 so that it can be engaged with the threaded connection 26 on the sleeve 22.

Figure 6:
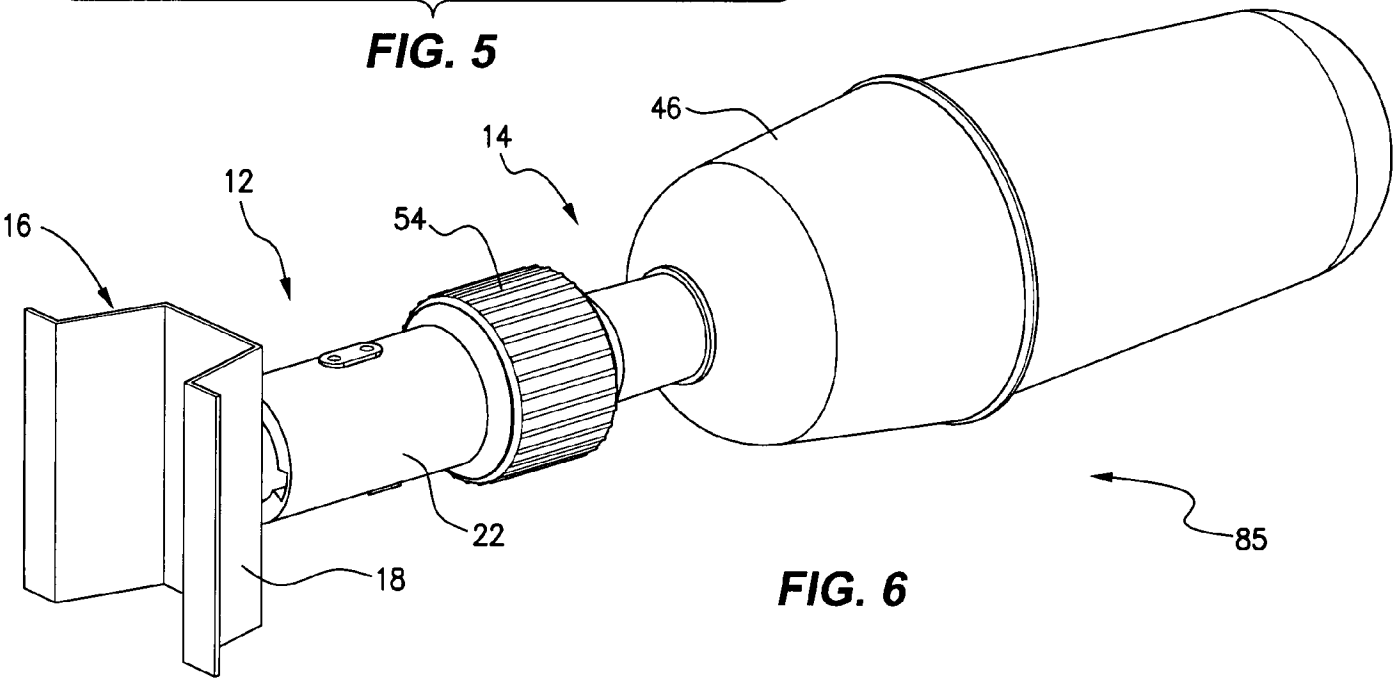
FIG. 6 is a perspective view of the mounted coupling and lamp fitting.

In use, mounting 12 is fixed to the bracket 16 and wired as described previously. The light holder 14 is engaged with the mounting 12, as shown in FIGS. 5 and 6 by engaging the locking ring 54 with the threaded connection 26 on the sleeve 22. The first and second electrical connections 30 and 50 are arranged such that when the locking ring 54 is fully engaged with the threaded connection 26, the first and second electrical connections 30 and 50 make contact, thereby providing power to the lamp in the lamp fitting 46.

When maintenance is required to be performed on a lamp fitting mounted on a coupling of the present invention, the light holder 14 can simply be disengaged from the mounting 12 by unscrewing the locking ring 54. A new lamp holder 14 with attached lamp fitting 46 may be used to replace lamp holder 14 requiring maintenance. The removed lamp holder 14 is taken to a suitable location, such as a workshop, for maintenance as required.

Figure 7:
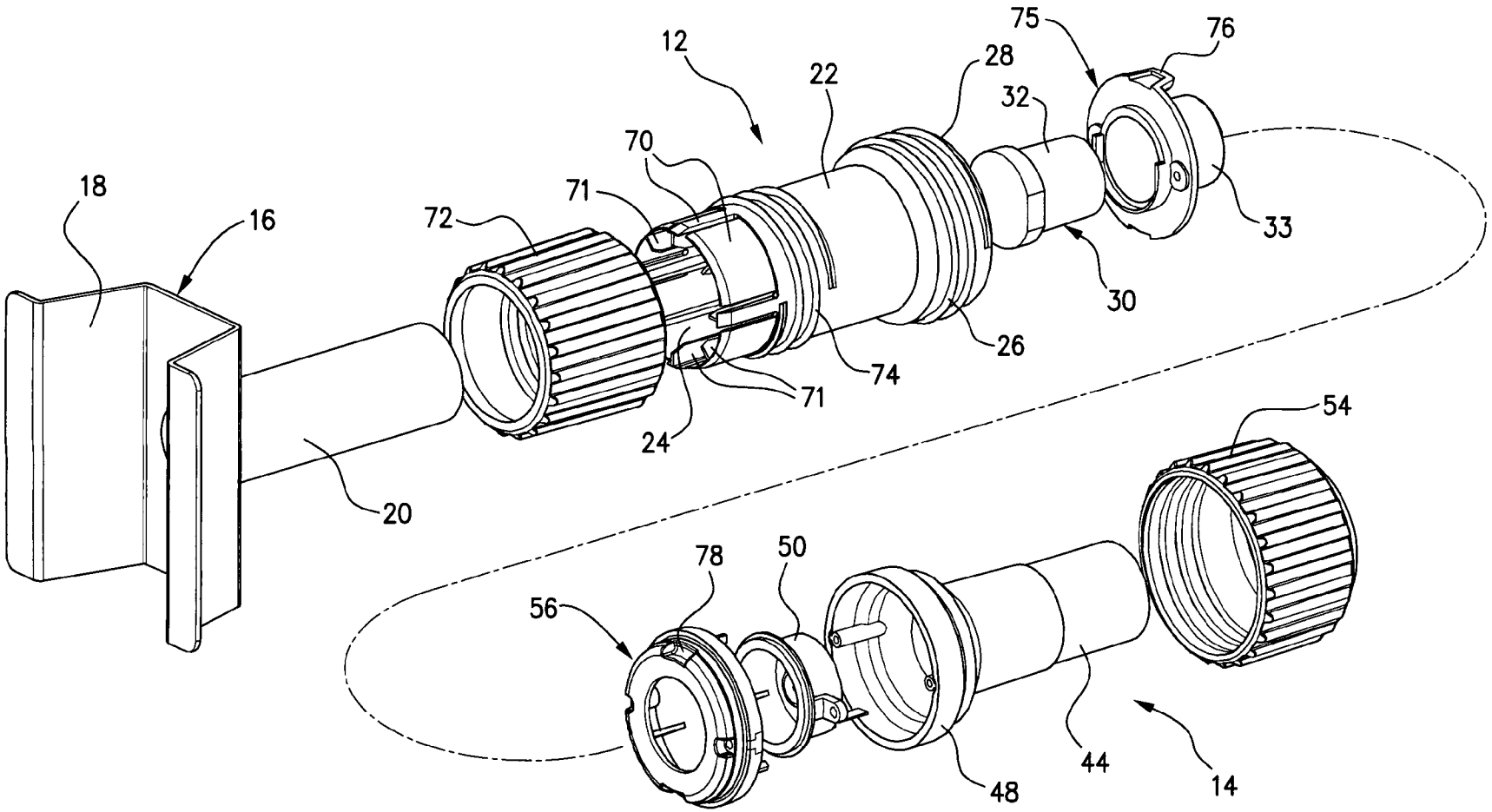
FIG. 7 is an exploded view of a second embodiment of the present invention.
Figure 8:
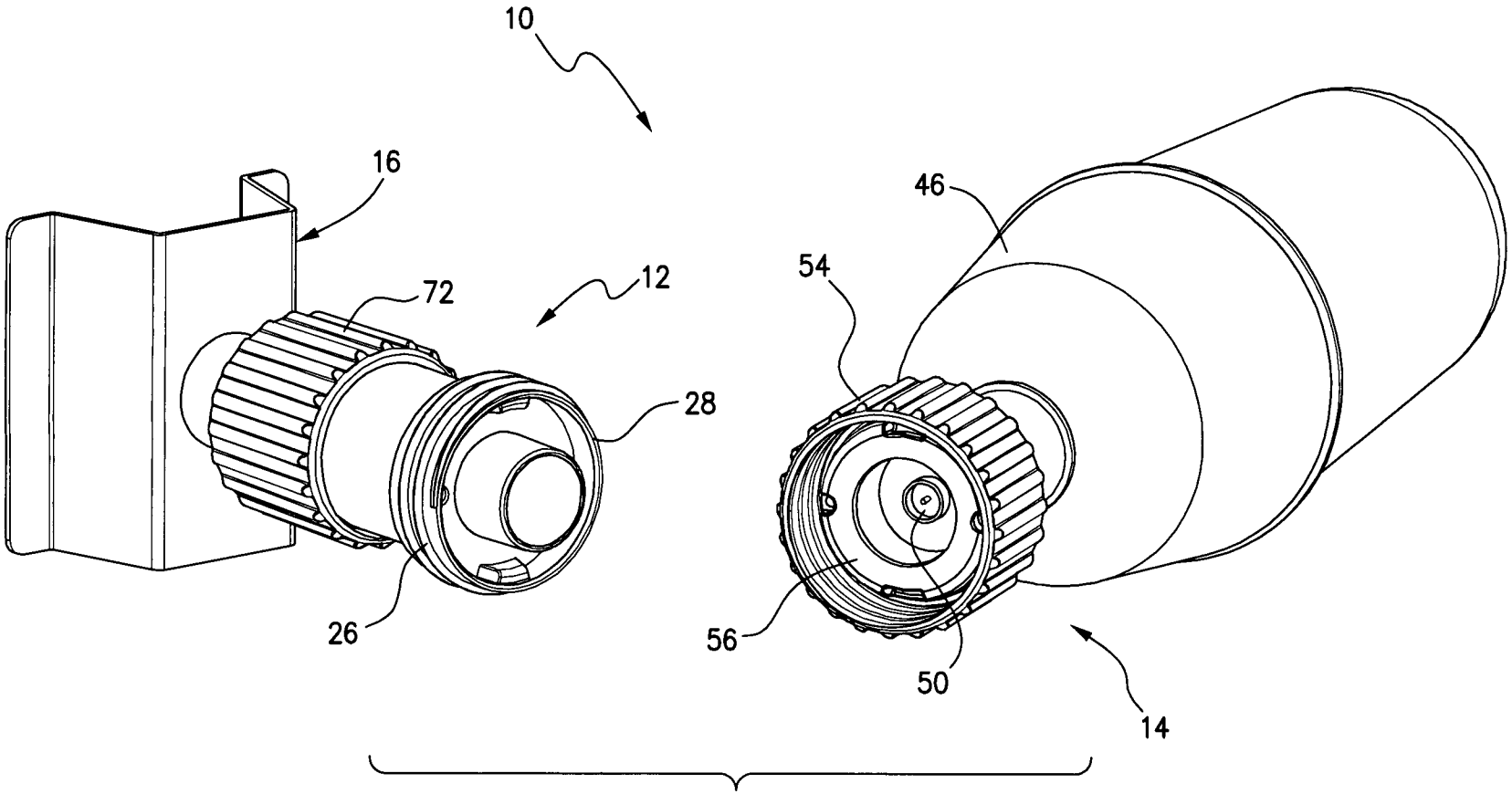
FIG. 8 is a perspective view of the coupling of FIG. 7 prior to engagement of the members. The coupling is shown with a lamp fitting attached.
Figure 9:
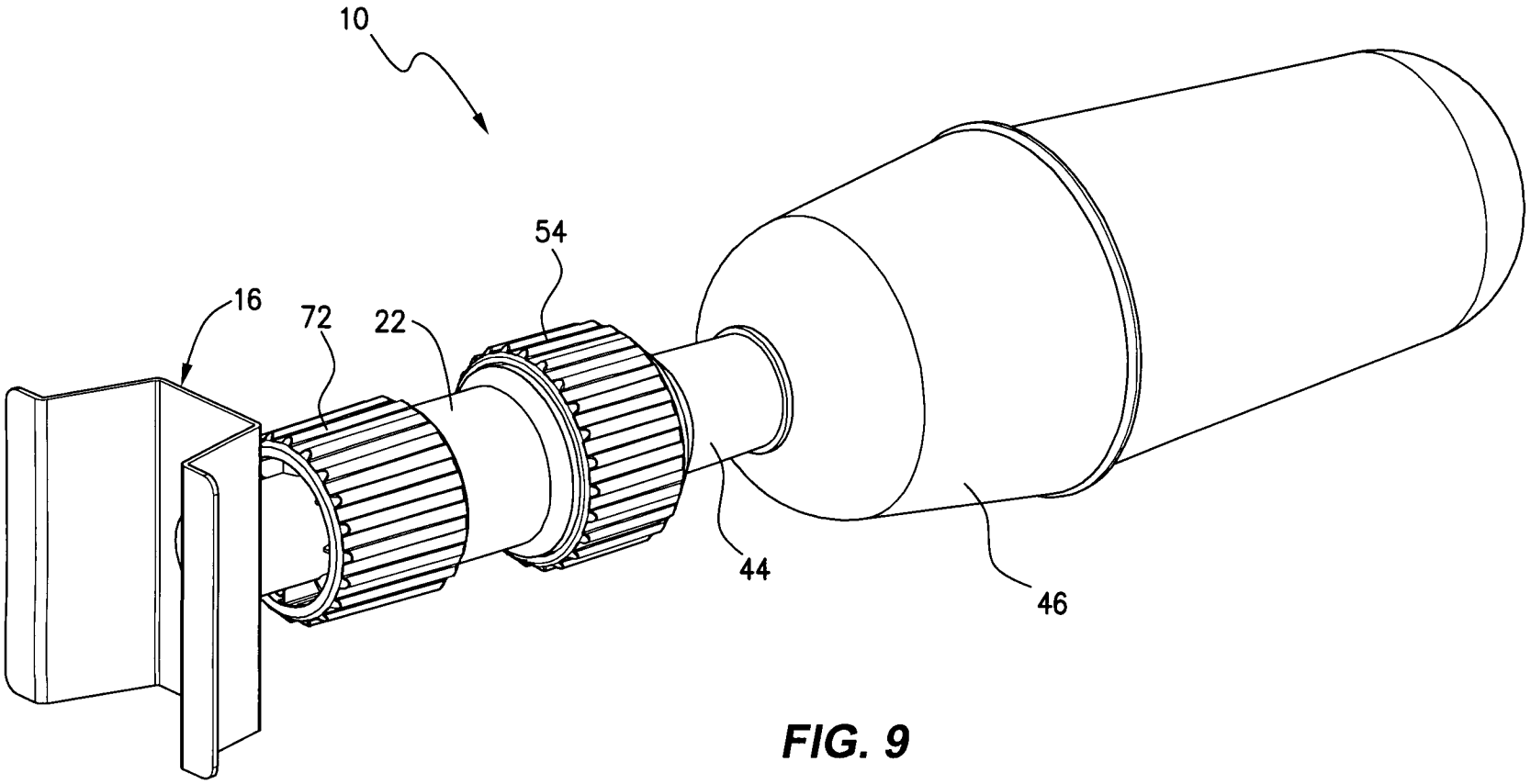
FIG. 9 is a perspective view of the coupling of FIG. 7 showing engagement of the two members.

FIGS. 7 to 9 show a second embodiment of a coupling 10 in accordance with the present invention in which like reference numerals are used to denote like parts. Coupling 10 of FIGS. 7 to 9 operates in essentially the same manner as the embodiment shown in FIGS. 1 to 6 with the exception of the means by which the coupling is secured to the bracket 16.

In the second embodiment, cylindrical sleeve 22 includes a plurality of deformable tabs 70 around open first end 24. Tabs 70 include internal fins 71 arranged longitudinally with respect to the sleeve 22 on inner surfaces thereof. Also provided is a second locking ring 72 to engage with an external thread 74 provided on the sleeve 22 adjacent the first end 24 thereof. The second locking ring 72 and deformable tabs 70 act in a manner similar to known hose fittings. That is, the cylindrical element or spigot 20 is received within the first end 24 of the sleeve 22 with the second locking ring 72 located around cylindrical element 20. The second locking ring 72 is then screwed onto sleeve 22, thereby compressing the deformable tabs 70 and fins 71 against the cylindrical element 20 to hold mounting 12 in place. It is expected that the components of the mounting 12 in this embodiment would be constructed of a plastic material.

The second embodiment of coupling 10 also differs from the previous embodiment in the way that mounting 12 is assembled and the manner in which mounting 12 and lamp holder 14 are located upon the engagement. Specifically first electrical connector 30 is inserted into the sleeve 22 from the second end thereof 28. The cylindrical projection 33 is provided on a second securing means 75 that is secured into the second end of the sleeve 22 after insertion of the electrical connector 30. Also provided is a locating lug 76 on the second end of the sleeve 22. The locating lug 76 on mounting 12 is received in a locating recess 78 on the light holder 14 such that the two parts are correctly oriented when the locating lug 76 and locating recess 78 are engaged.

FIGS. 10 to 15 show a third embodiment of a coupling in accordance with the present invention. This embodiment differs from the previous embodiment is in the way that mounting 12 and lamp holder 14 are engaged. Specifically, mounting 12 includes a first connecting cylinder 80 at the second end instead of a threaded connection. The light holder 14 comprises a second connecting cylinder 82. Into a first end thereof second connecting cylinder 82 receives first connecting cylinder 80. The term "cylinder" means substantially cylindrical and includes where the wall of the cylinder has a taper or incline. The connecting cylinders described in this embodiment have a slight taper or incline. The internal diameter and profile of the second connecting cylinder 82 is equal to the external diameter and profile of the first connecting cylinder 80 such that the first connecting cylinder 80 is slidingly received in use in the second connecting cylinder. It is expected that the first and second connecting cylinders 80 and 82 would be constructed of metal, such as aluminum, and this arrangement used for larger light fittings to allow better transfer of the weight of the lamp holder to the bracket 16. This feature means that the light fitting can be manipulated more easily with a single hand thus enabling a worker to meet safety requirements, especially when working at height.

Figure 10:
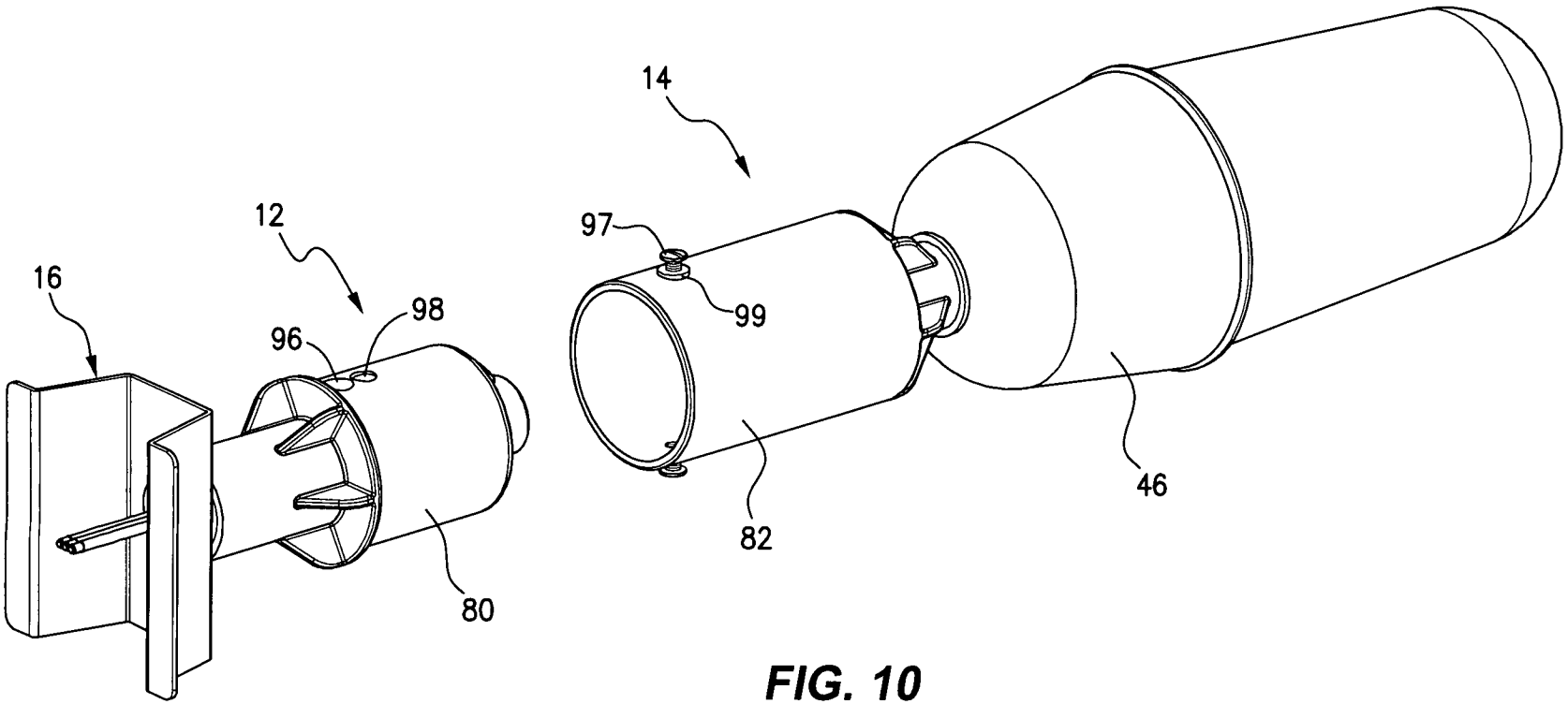
FIG. 10 is a perspective view of the third embodiment of the coupling of the present invention prior to engagement of the members.
Figure 11:
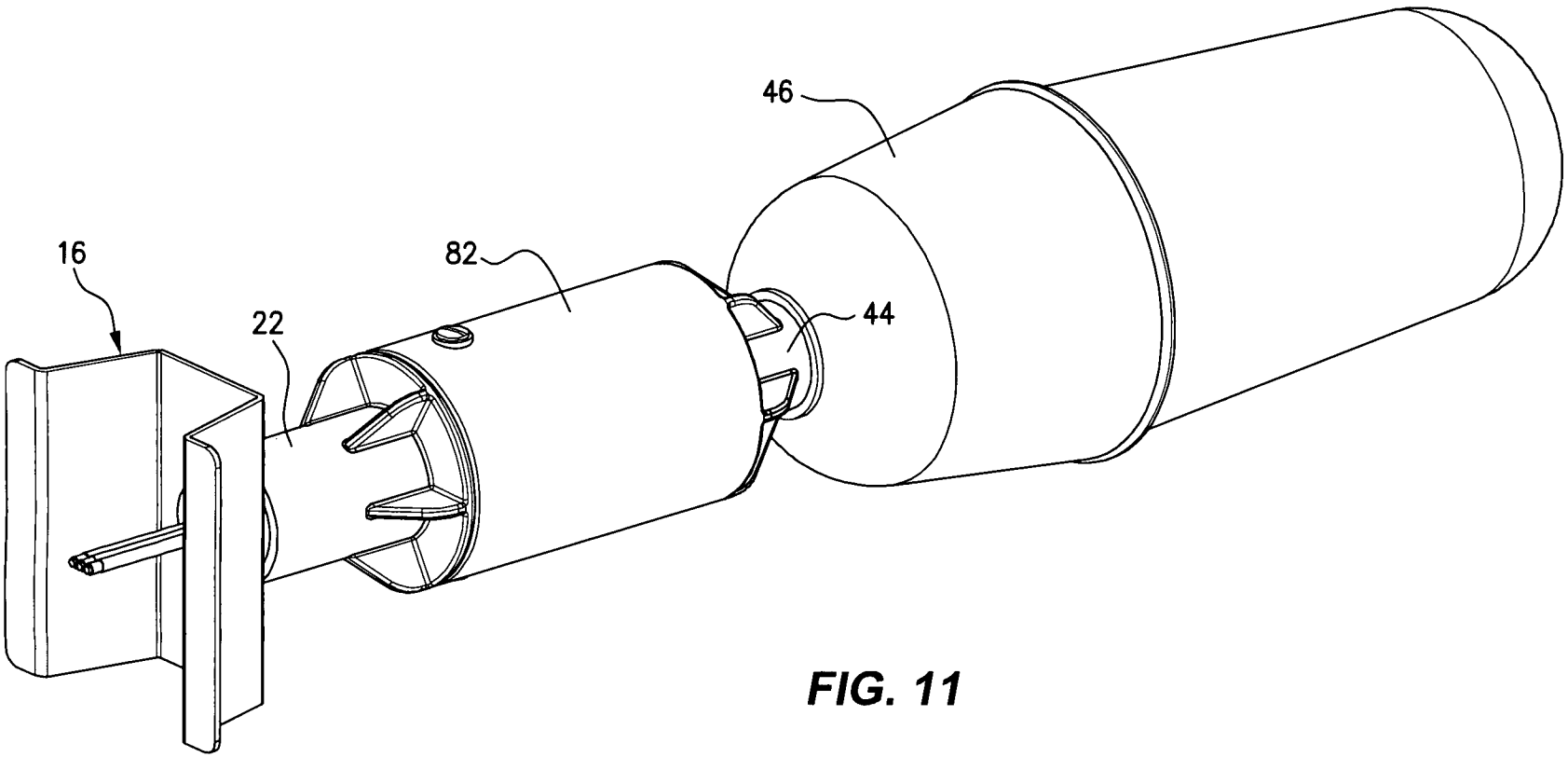
FIG. 11 is a perspective view of the coupling of FIG. 10 where the two members are engaged.
Figure 12:
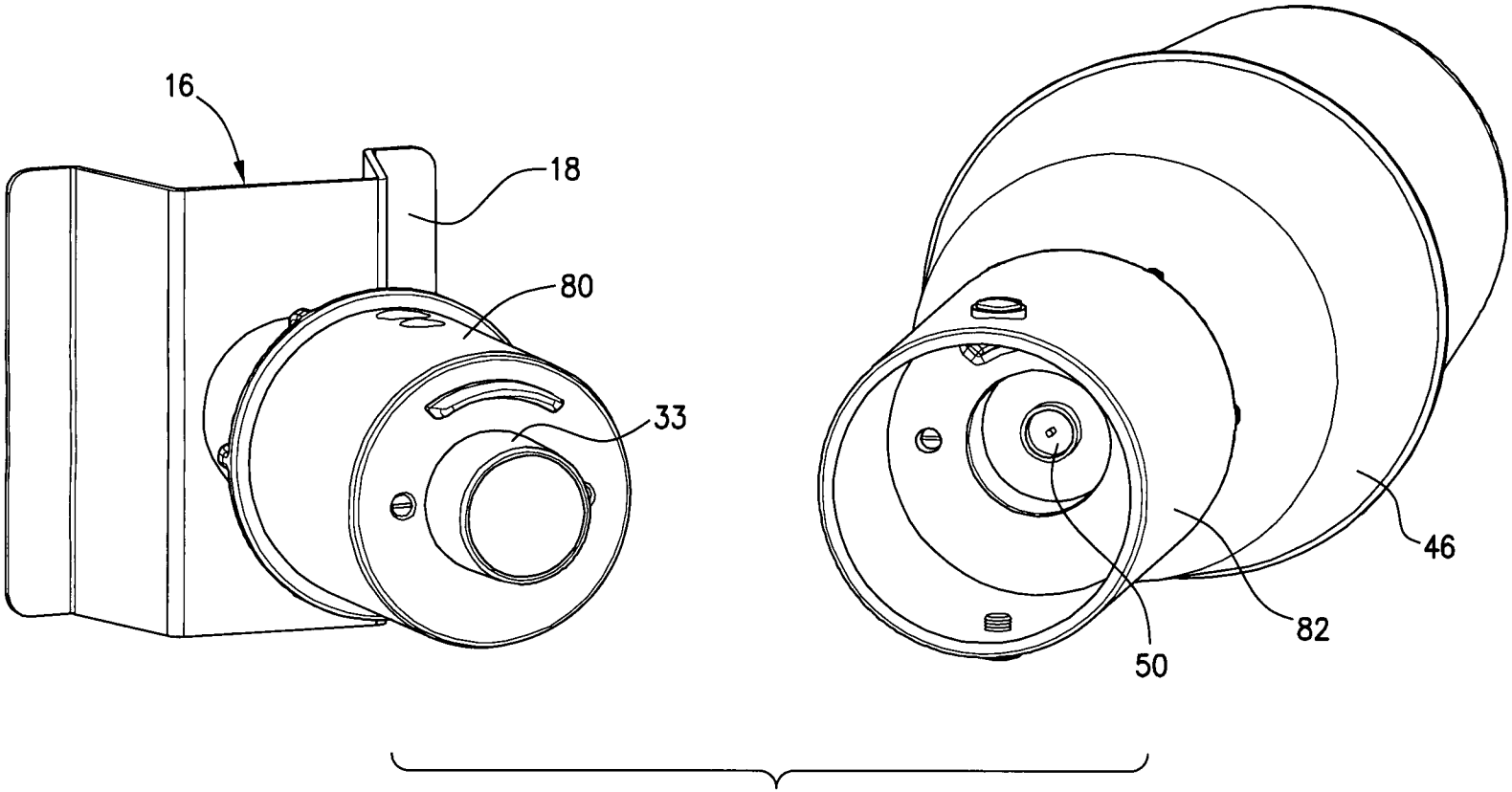
FIG. 12 is the further perspective view of the coupling of FIG. 10 prior to engagement of the two members.
Figure 15A:
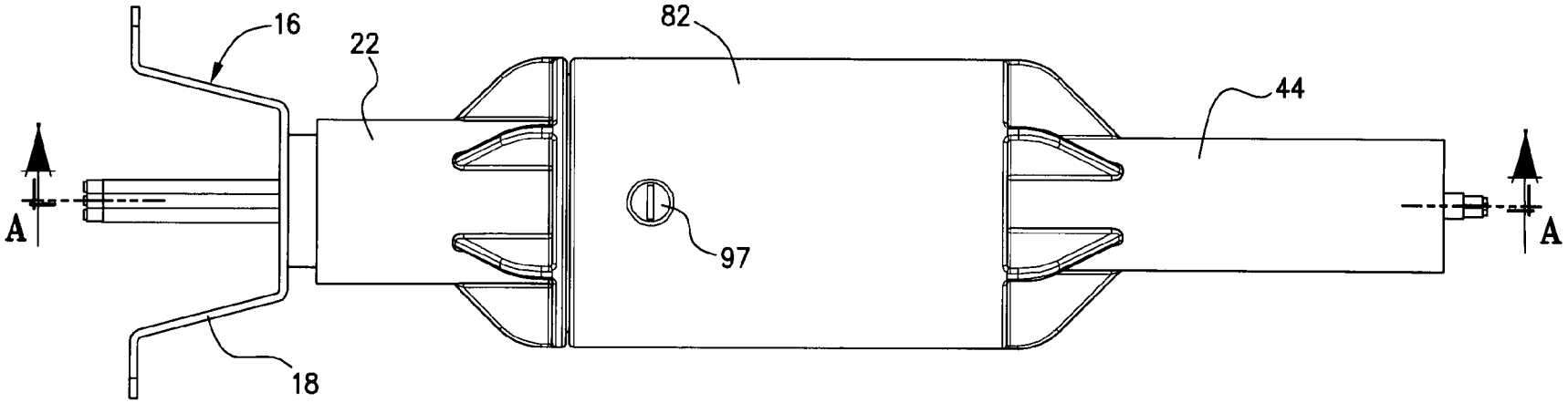
FIGS. 15A and 15 B are respectively a side view and a side cross-sectional view of the coupling of FIG. 10.
Figure 15B:
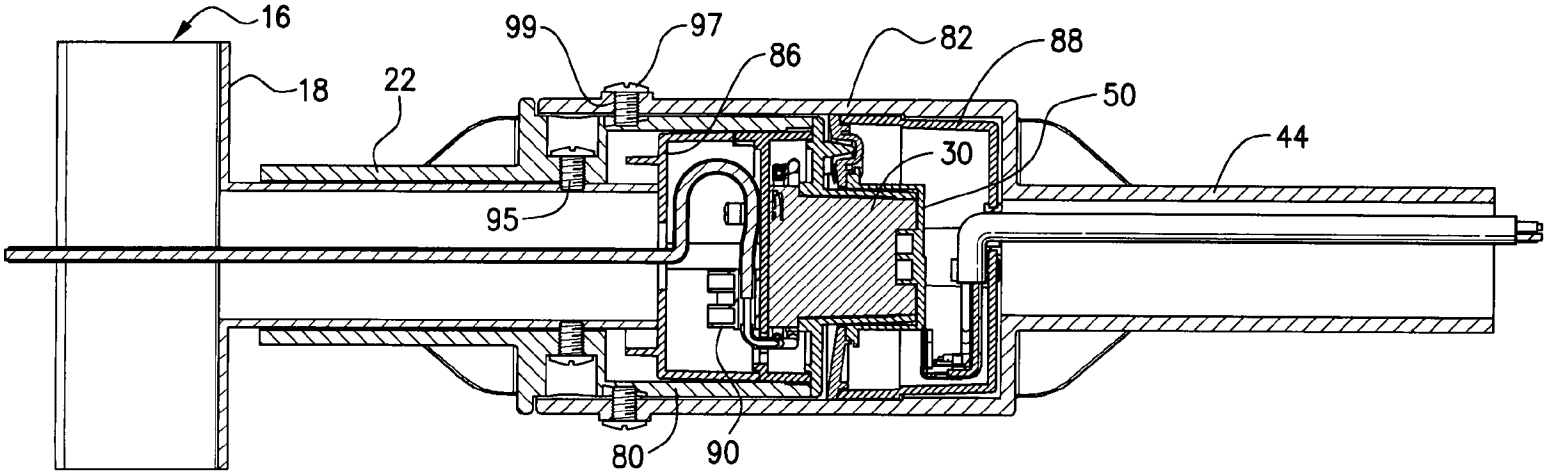
Figure 16A:
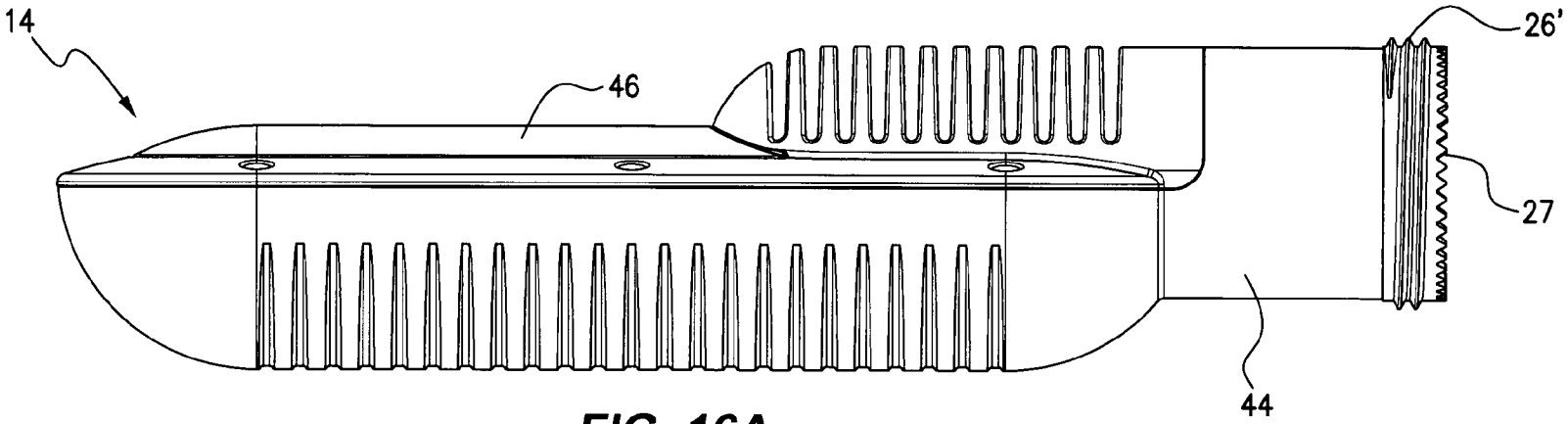
FIGS. 16A to 16E show a fourth embodiment of the present invention where the holder member and the lamp fitting comprising a single unit. Respectively
Figure 16B:
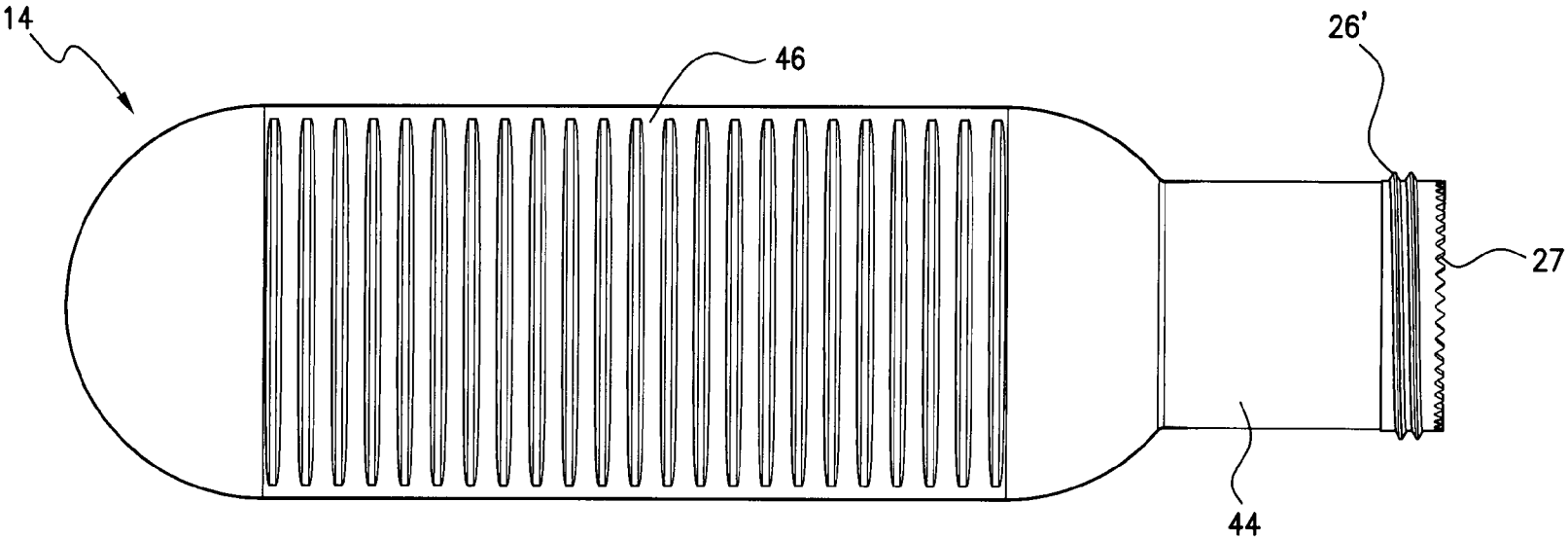
Figure 16C:
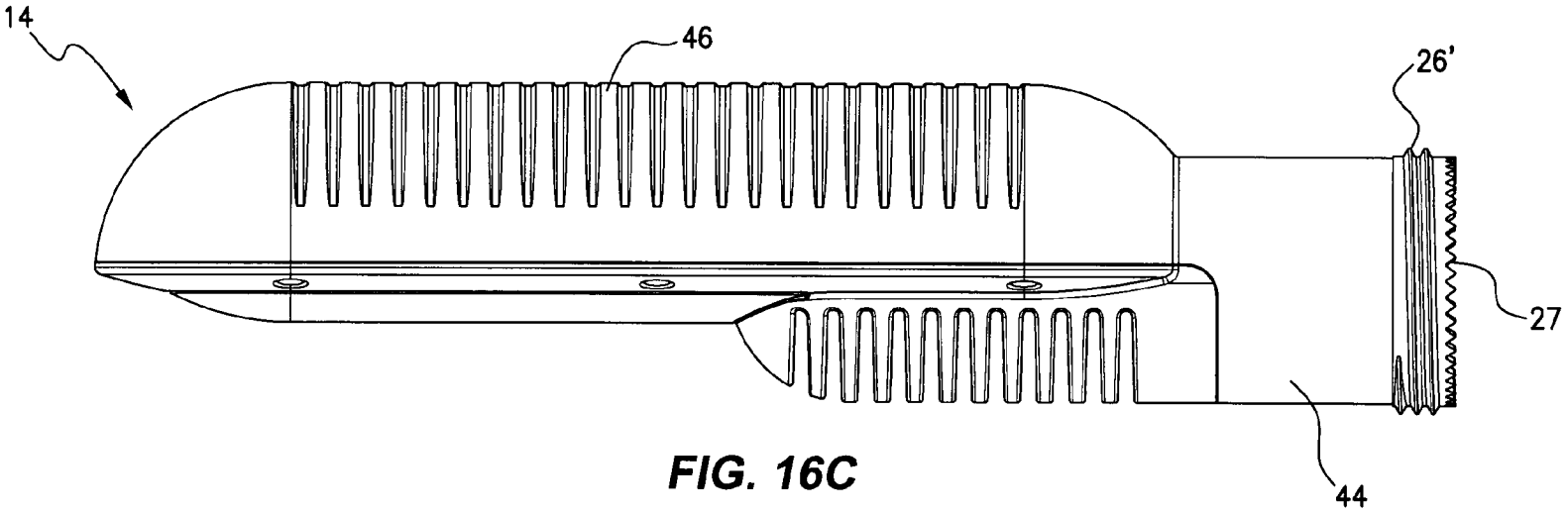
Figure 16E:
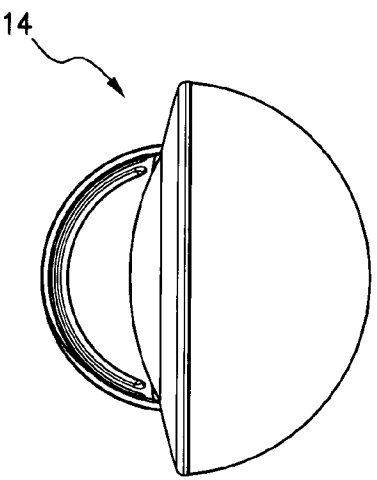
Figure 16D:
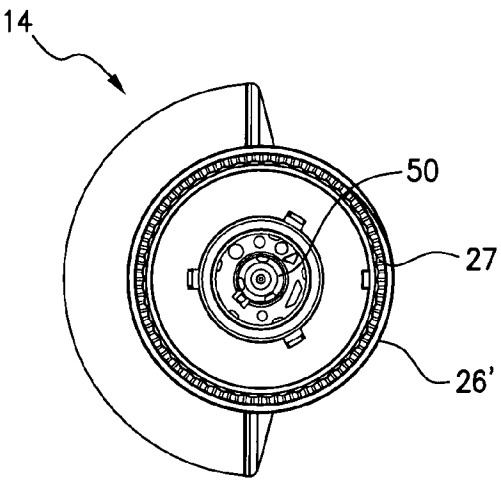
Figure 17A:
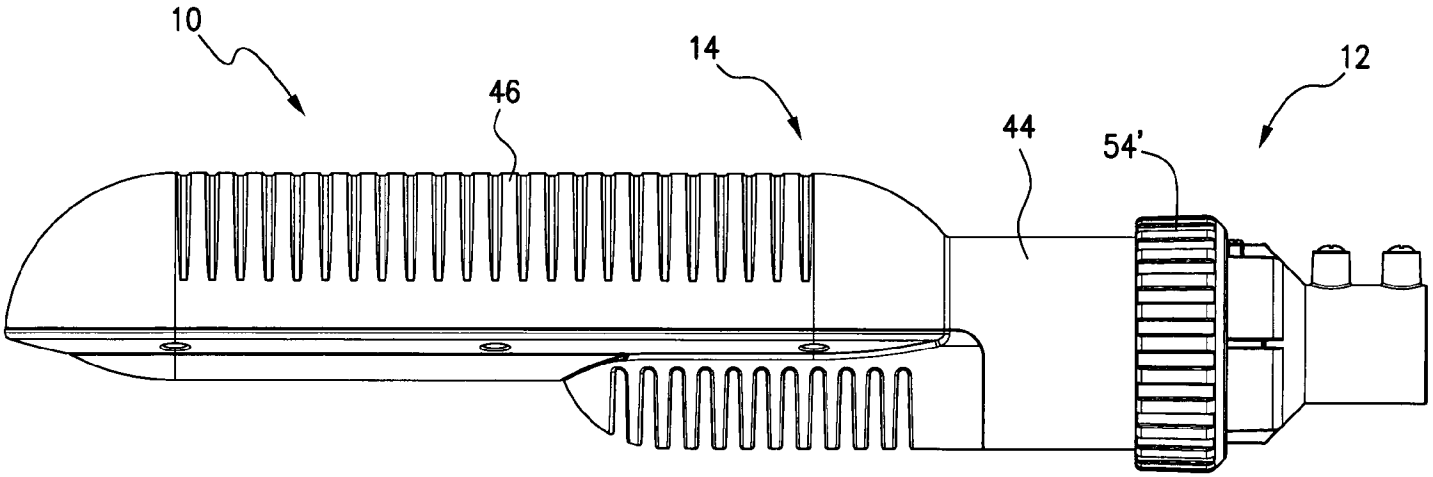
FIG. 17 A is the side view of the unitary fitting the FIG. 16 showing engagement with the mounting member.
Figure 17B:
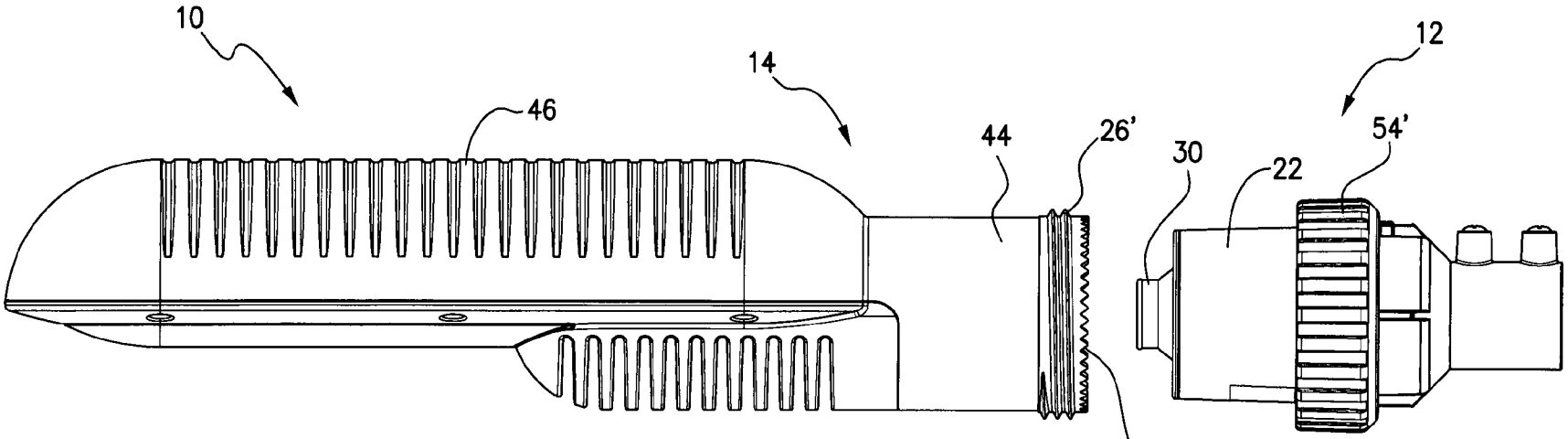
Figure 18:
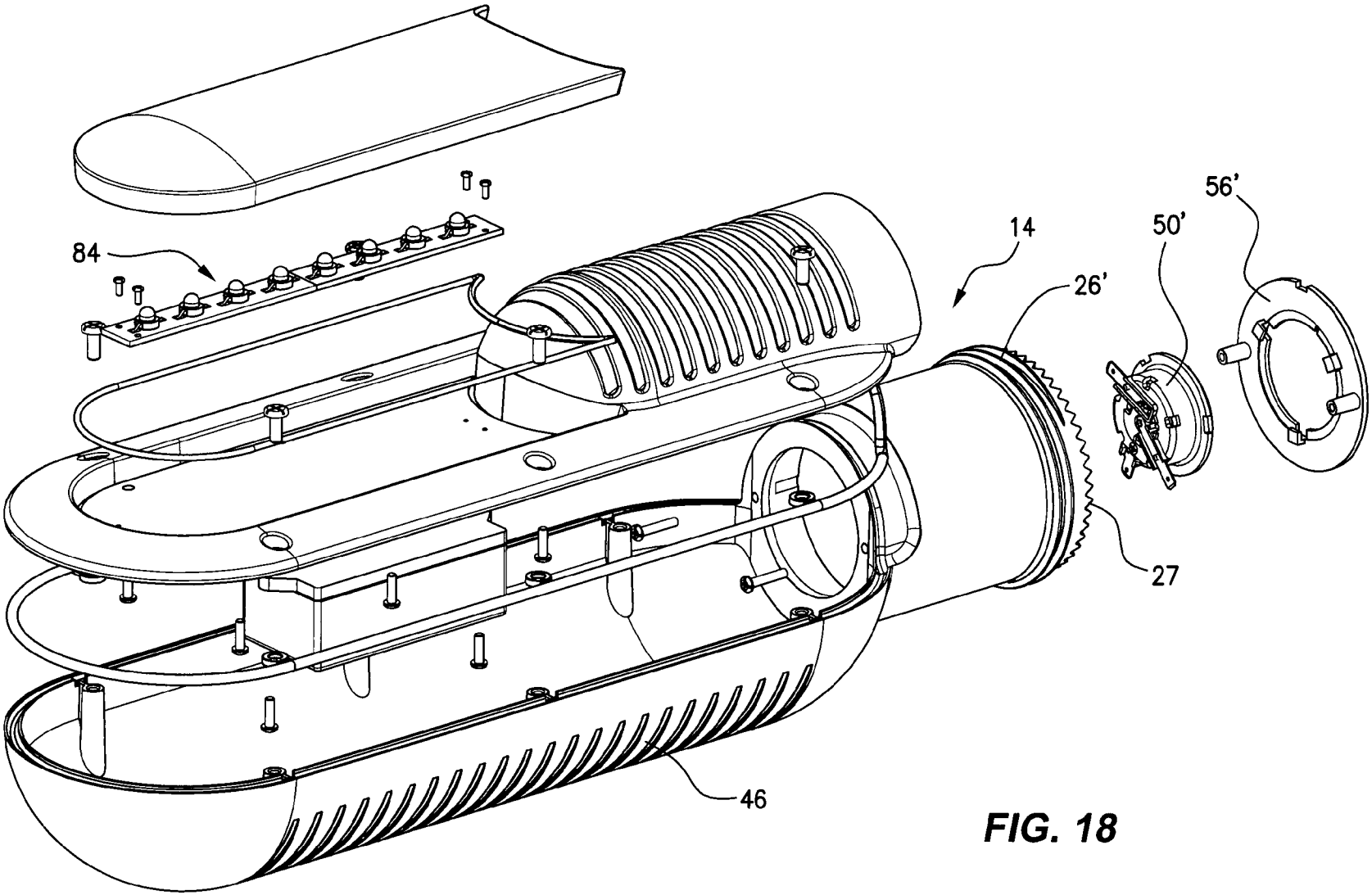
FIG. 18 is an exploded view of the unitary fitting of FIG. 16.
Figure 19A:
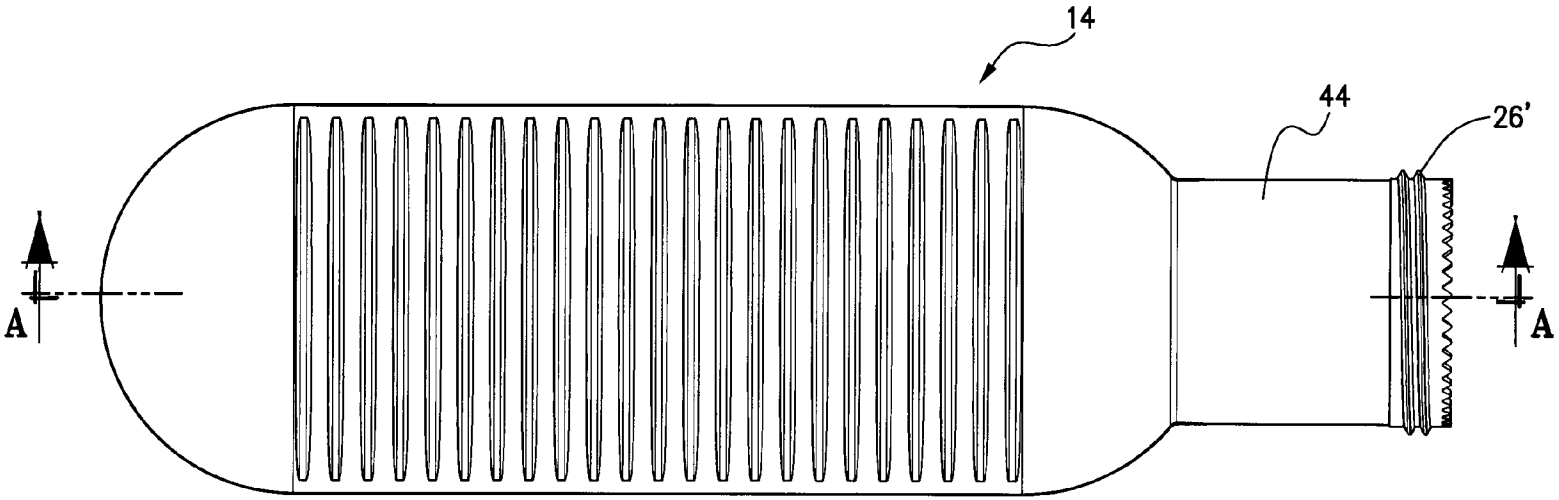
FIG. 19 A is a top view of the unitary fitting of FIG. 16.
Figure 19B:
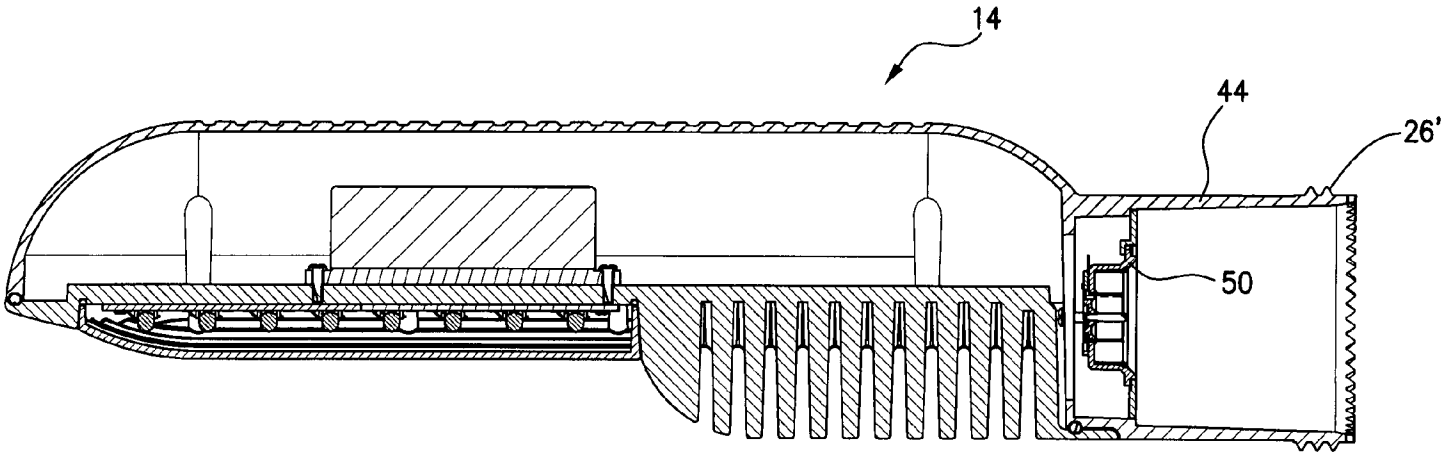

The first connecting cylinder 80 is secured to the cylindrical element or spigot 20 of bracket 16 by means of a first screw 95 received in a first hole 96 in the first connecting cylinder 80. The screw 95 engages with the cylindrical element 20 as shown in FIG. 15B. The second connecting cylinder 82 is secured to the first connecting cylinder 80 by fixing means in the form of a second screw 97 received in a second hole 99 in the second connecting cylinder 82. Other fixing means such as pins may be contemplated. A The second screw 97 engages in an indentation 98 in the outer surface of the first connecting cylinder 80 as shown in FIGS. 10 and 15 B.

Figures 13, 14:
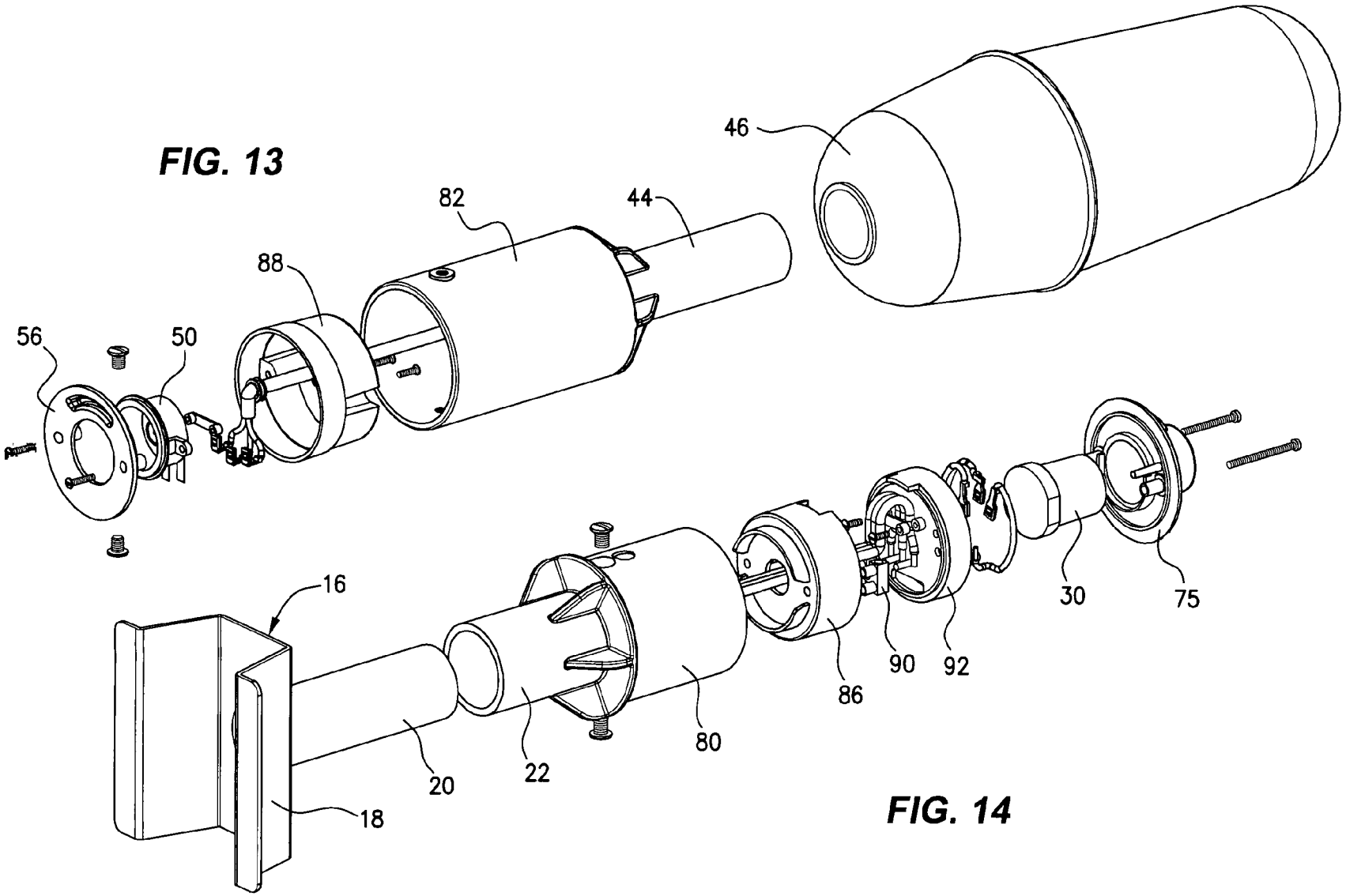
FIG. 13 is an exploded view of the holder member of the coupling according to the embodiment of FIG. 10.
FIG. 14 is an exploded view of the mounting member of the coupling according to the embodiment of FIG. 10.

As shown in FIG. 13, the second connecting cylinder 82 receives the second electrical connector 50 which is secured in place with the securing means 56. The first electrical connector 30 is secured in the first connecting cylinder 80 with the second securing means 75 in the same manner as the second embodiment shown in FIGS. 7 to 9. The first and second electrical connectors 30 and 50 are arranged such that they engage when the first connecting cylinder 80 is received in the second connecting cylinder 82.

The coupling 10 of the third embodiment also includes a first insulating element 86 which is received in the first connecting cylinder 80 before the first electrical connector 30 is inserted into the first connecting cylinder. The first insulating element 86 is constructed of a non-conductive material and electrically isolates the first electrical connector from the first connecting cylinder 80. A second insulating element 88 is provided in the second connecting cylinder 82 before the second electrical connector 50 is inserted into the second connecting cylinder. The second insulating element 88 is constructed of a non-conductive material and electrically isolates the second electrical connector from the second connecting cylinder 82.

The mounting 12 is also provided with a connector mounting block 90 on terminal shield 92. First electrical connector 30 is held between terminal shield 92 and the second securing means 75. In this way, a single unit comprising the second securing means 75, first electrical connector 30 and terminal shield 92 can be connected on location to the power cable by connecting at the connector mounting block 90, which makes for a simpler process than having to connect to the electrical connector in the form of the Otter brand connector, Strix brand connector including the P 72 model and Ketsol connector.

FIGS. 16 to 19 show a fourth embodiment of a coupling in accordance with the present invention. Like numerals are used to denote like parts. The fourth embodiment is similar to the first embodiment described above however the lamp fitting 46 and the second cylindrical element 44 are formed as an integral unit. The lamp fitting 46 in the embodiment shown houses a plurality of LED 84.

The second cylindrical element 44 connects to the first cylindrical element 22 by means of a threaded connection 26' and a locking ring 54', however the threaded connection 26' is provided on the second cylindrical element 44 and the locking ring 54' is provided on the first cylindrical element 22'.

The threaded connection 26' is provided with a serrated edge 27 that engages during connection with a corresponding serrated edge (not shown) on the first cylindrical element 22.

The engagement of the serrated edges restricts relative rotational movement of the lamp holder 14 and the mounting 12 once the locking ring 54' is tightened. The rotational movement can be adjusted in 5° increments for accurate positioning of the lamp. This means that the lamp fitting can be fixed in a desired position, for example when lighting in a particular direction is required.

Figure 20A:
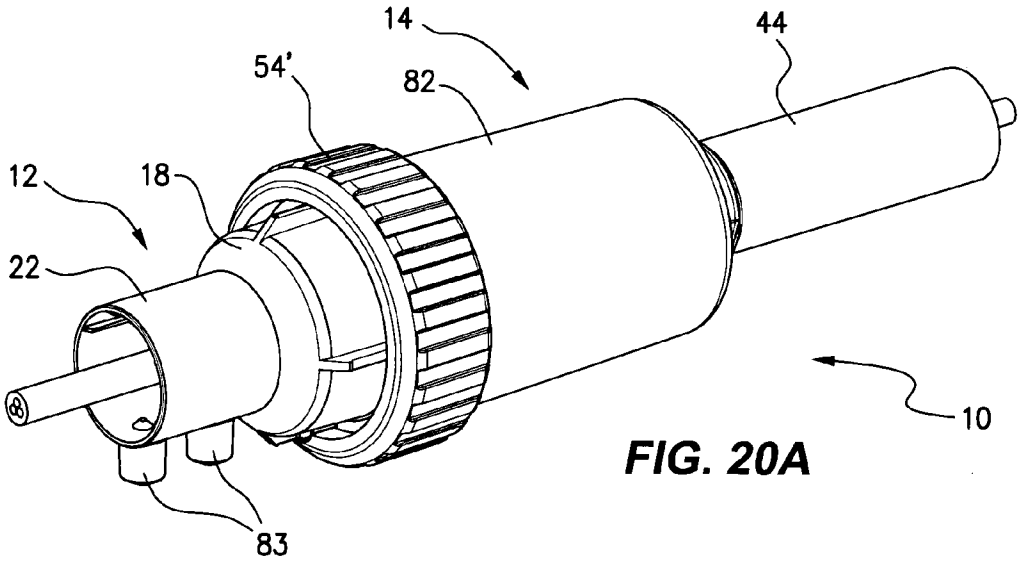
FIG. 20 A is a perspective view of a fifth embodiment of the coupling in accordance with the present invention.
FIG. 20B is a side cross-sectional view of the coupling of FIG. 20 A.
Figure 20B:
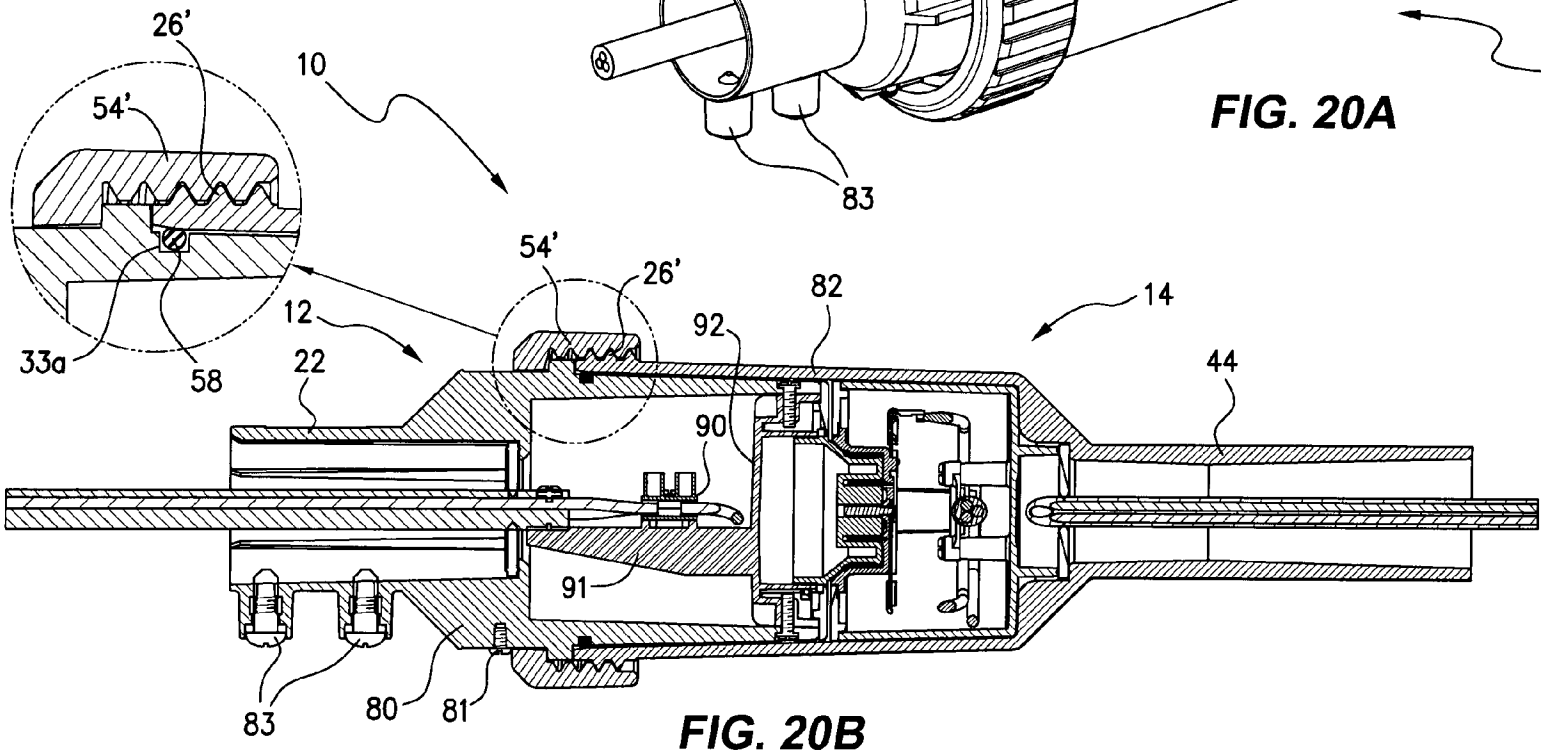
Figure 21:
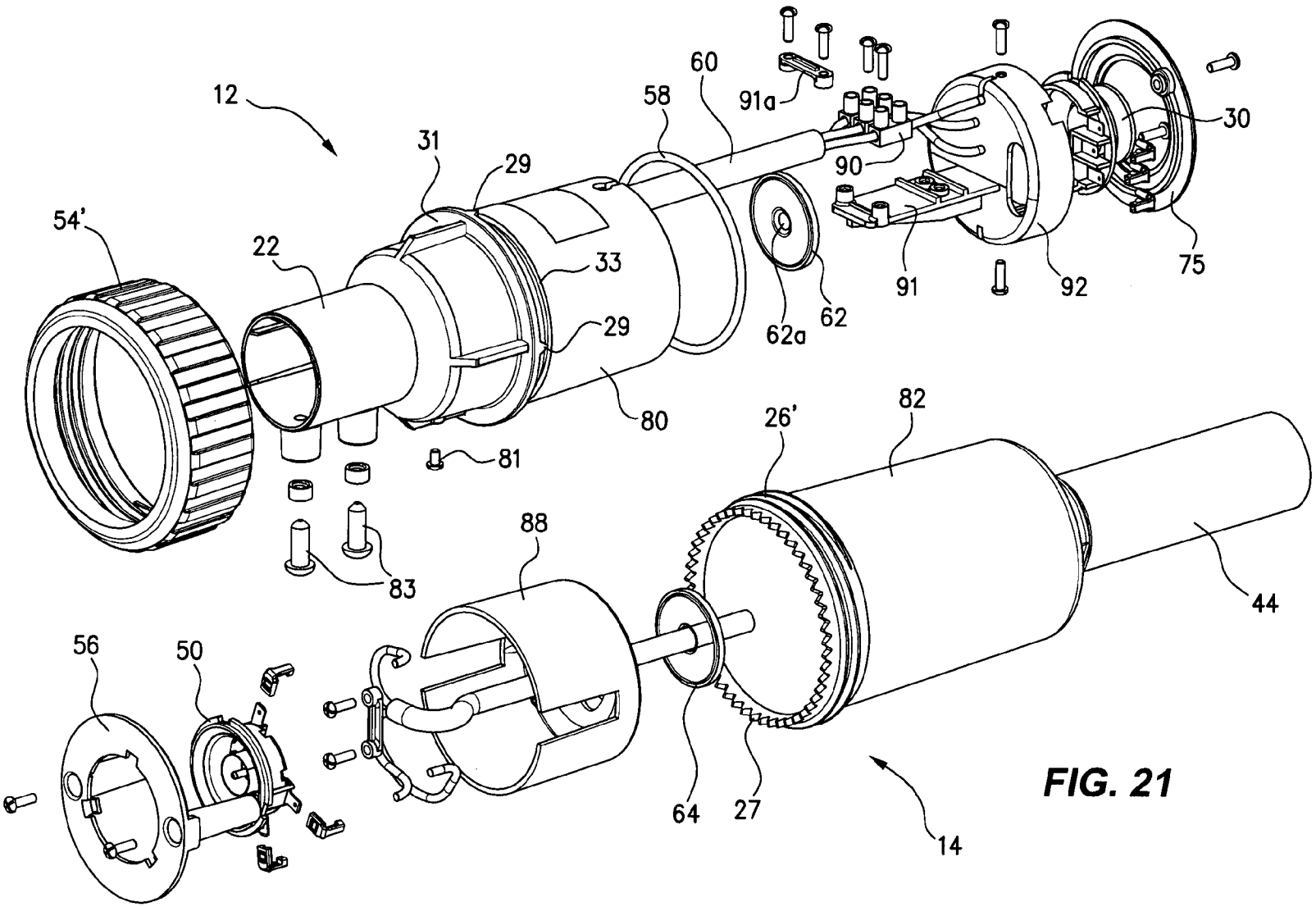
FIG. 21 is an exploded view of the coupling of FIG. 20.

FIGS. 20 and 21 show a fifth embodiment of a connector in accordance with the present invention. The fifth embodiment includes elements similar to third embodiment however the first connecting cylinder 80 and the second connecting cylinder 82 are connected together by means of a locking ring 54' in the same manner as the fourth embodiment. That is, the locking ring 54' is provided on the first connecting cylinder 80 and the threaded connection 26' is provided on the second connecting cylinder 82. There is also provided serrated edge 27 on the end of the second connecting cylinder 82. The serrated edge 27 engages with corresponding teeth 29 which are radially disposed on flange 31 such that the teeth 29 engage with the serrated edge 27 when the light holder 14 and mounting 12 are engaged.

The cylindrical sleeve 22 is provided with a pair of clamping screws 83 located on a side of the cylindrical sleeve 22. The clamping screws 83 secure the mount 12 to the light pole. In use these screws are oriented downwards to assist in weather resistance of the housing and avoid buildup of dirt.

Also, a retaining screw 81 is provided to be received in a threaded aperture in the body of the first connecting cylinder 80 behind the locking ring 54' when the locking ring 54' is secured in place. The retaining screw 81 prevents removal of the locking ring 54' and therefore ensures that a tool is required to remove the light holder 14 from the mounting. Some safety authorities and worksites require a tool to be used for removal of an electrical fitting. Retaining screw 81 allows compliance with this requirement.

Further, an o-ring 58 is provided adjacent the flange 31 in a groove or recess 33*a* in the first connecting cylinder 80 such that the o-ring 58 creates a seal against the inner surface of the second connecting cylinder 82. When the connecting cylinders are slid together their tapered profiles assist in keeping the o-ring in place in groove 33*a*. The o-ring helps provide weather resistance.

The fifth embodiment also includes connector mounting block 90 adjacent to terminal shield 92 as in the third embodiment. Terminal shield 92 is provided with a connector support plate 91 extending transversely from a face thereof onto which the connector mounting block 90 is secured by a cable restraint 91*a* which is fixed in place by screws. During assembly of mounting 12 cable 60 comprising electrical wires is pushed through a centrally located region 62*a* in rubber diaphragm or membrane 62 (diaphragm 62 is shown as offset in FIG. 21). Centrally located region 62*a* comprises a frangible or weakened area on the diaphragm which once cable 60 is pushed through results in a self sealing aperture and provides a snug seal. A similar membrane or diaphragm 64 is provided in lamp holder 14. This helps to provide protection against moisture entry to the housing and enhances weather resistance.

Although the embodiment described above relate to a mounting members suitable for attachment to conventional spigot mounts the invention also contemplates a coupling where the mounting member comprises an end with a flat base suitable for mounting directly to a wall or other planar surface. It is contemplated that the mounting member will be generally cylindrical in shape and contain a centrally located first electrical connector element in the form of a female member and terminal blocks peripheral thereto with adjacent cable entries to allow wiring to the power supply. The holder member will contain the second connector element in the form of a complementary male connector prewired to a lamp fitting such as a flood light. The members will be suitably threaded and fixed together by a complementary threaded locking ring.

Thus it can be seen with the connector of the present invention that installation and maintenance of lamp fittings is easy, convenient and less time-consuming. This is a particularly important advantage as many of the industrial lamp fittings are mounted at heights which require the worker to work on an elevated safety platform. Typical time taken to replace a standard pole mounted light fitting including accessing the fitting is around five hours at a mining site. With the connector of the present invention it is estimated that the time taken to replace a standard pole mounted light fitting including the worker using an elevated safety platform is around about 10 minutes. Further the fact that in some embodiments lamp holder 14 can be slidingly engaged with mounting 12 prior to securing locking ring 54 means that the lamp fitting can be changed one-handed. This is important since certain safety standards require a worker to have three points of secure contact at any one time, thus only leaving one hand free to perform a maintenance task. In addition industrial sites such as mining sites often have poor records of electrical circuitry, if any records exist at all. This means that presently in order to change a light fitting the electrician or worker may have to devote considerable amount of time in identifying and isolating the electrical circuit in question to allow the light fitting to be changed. In addition, safety standards in some countries require extensive documentation before an electrical circuit can be isolated. The fact that the present invention allows a light fitting to be connected and disconnected under full power load safely provides extremely advantageous time savings at these industrial sites.

Throughout this specification and the claims that follow, unless the context requires otherwise the words "comprise", "comprises", "comprising" will be understood to mean the inclusion of the stated integer, step or group of integers or steps but not the exclusion of any of other integer, step or group of integers or steps.

Modifications and variations as would be apparent to a skilled addressee are deemed to be within the scope of the present invention.

The invention claimed is:

1. A coupling for use with a lamp fitting operated by a power supply, which coupling allows safe mounting/dismounting of the fitting without electrical isolation from the supply, said coupling comprising:

a mounting member having a first electrical connector element with shielded contact points connectable to the power supply, said member being suitable for fixing to a structure, wherein the first electrical connector is disposed within a housing of the mounting member to at least partially isolate the first electrical connector within the housing of the mounting member; and a holder member engageable with the mounting member and comprising a cylindrical element adapted to receive at least a portion of the mounting member and able to support a standard or industrial commercial lamp fitting having a lamp, said holder member having a second electrical connector element able to conduct power to a lamp fitting, wherein the second electrical connector is disposed within a housing of the holder member to at least partially isolate the second electrical connector within the housing of the holder member;

wherein engagement of the mounting member and the holder member allows the first and second electrical connector elements to come into contact and disengagement allows electrical contact to be broken without substantial exposure of the contact points;

wherein, when engaged, the mounting member and the holder member form a water-resistant housing and the housing has a longitudinal axis, and wherein the mounting member and the holder member are engageable through a full 360 degrees of rotation about the longitudinal axis.

2. The coupling of claim 1 wherein, when engaged, the members form a protective housing.

3. The coupling of claim 2, wherein the holder member and the mounting member are securable by rotation of a locking ring about the axis.

4. The coupling of claim 3, wherein the members are of suitable dimensions such that engagement is provided by one part of one member sliding over and at least partially around another part of the other member.

5. The coupling of claim 4, wherein a part of the holder member slides over and at least partially around a part of the mounting member.

6. The coupling of claim 5, wherein at least one of the members comprises a substantially cylindrical sleeve with a tapered wall.

7. The coupling of claim 6, wherein the members are of suitable dimensions and materials, such that when slidingly engaged, the coupling is able to support the weight of the lamp fitting prior to fixing of the two members together, thus enabling one-handed engagement/disengagement of the members.

8. The coupling of claim 6, wherein at least one of the members is threaded and the members are fixable together by a complementary threaded annular element that slides over the other member and is screwed on.

9. The coupling of claim 6, wherein the members are fixable together with a suitable fixing means received by an aperture in one of the members.

10. The coupling of claim 6, wherein the mounting member is suitable for use with a spigot mounting or suitable for mounting directly on a planar structure.

11. The coupling of claim 1 wherein, when engaged, the members form a weather-resistant housing.

12. A lamp fitting when attached to the holder member as defined in claim 1.

13. An integrated lamp fitting and holder member suitable for coupling with the mounting member of claim 1.

14. The lamp fitting and holder member of claim 13, wherein the lamp comprises LED.

15. Use of the coupling of claim 1 to mount a lamp fitting to a structure.

16. An improved method of mounting a lamp fitting operated by a power supply, which improvement allows safe mounting/dismounting of the fitting without electrical isolation from the supply, said method comprising: providing a mounting member having a first electrical connector element with shielded contact points connectable to the power supply; and a holder member engageable with said mounting member, said holder member comprising a cylindrical element adapted to receive at least a portion of the mounting member and able to support a standard or industrial commercial lamp fitting having a lamp, said holder member having a second electrical connector element able to conduct power to the lamp fitting; wherein each of the first electrical connector and the second electrical connector is disposed within a respective housing to at least partially isolate the first electrical connector and the second electrical connector from contact with a user during engagement and disengagement of the mounting member and the holder member, and wherein engagement of the mounting member and the holder member allows the first and second electrical connector elements to come into contact and disengagement allows electrical contact to be broken without substantial exposure of the contact points, wherein, when engaged, the mounting member and the holder member form a water-resistant housing and the housing has a longitudinal axis, and wherein the mounting member and the holder member are engageable through a full 360 degrees of rotation about the longitudinal axis; and fixing said mounting member to a structure, connecting it to the power supply, engaging the holder member and a lamp fitting with the mounting member.

17. The method of claim 16, wherein the holder member and the lamp fitting comprise an integral unit.

18. The method of claim 17, wherein the lamp comprises LED.

19. An improved method of maintenance of industrial or commercial lamp fittings operated by a power supply, which method allows safe mounting/dismounting of the fittings without electrical isolation from the supply, said method comprising: provision of lamp fittings associated with couplings each coupling comprising: a mounting member having a first electrical connector element with shielded contact points connected to the power supply, said member being fixed to a structure and engageable with said mounting member, a holder member engageable with the mounting member and comprising a cylindrical element adapted to receive at least a portion of the mounting member and able to support a standard or industrial commercial lamp fitting having a lamp, the holder member having a second electrical connector element able conduct power to the lamp fitting;

wherein each of the first electrical connector and the second electrical connector is disposed within a respective housing to at least partially isolate the first electrical connector and the second electrical connector from contact with a user during engagement and disengagement of mounting member and the holder member;

wherein engagement of the mounting member and the holder member allows the first and second electrical connector elements to come into contact and disengagement allows electrical contact to be broken without substantial exposure of the contact points, wherein, when engaged, the mounting member and the holder member form a water-resistant housing and the housing has a longitudinal axis, and wherein the mounting member and the holder member are engageable through a full 360 degrees of rotation about the longitudinal axis, the improvement comprising that replacement of lamp fittings can be carried out under full power load by disengaging said holder member and replacing it with a fresh lamp fitting attached to a second holder member; and wherein the lamp fittings are industrial or commercial lamp fittings.

20. The method of claim 19, wherein the holder member and the lamp fitting comprise an integral unit.

* * * * *

UNITED STATES PATENT AND TRADEMARK OFFICE

CERTIFICATE OF CORRECTION

PATENT NO. : 8,905,603 B2
APPLICATION NO. : 12/998007
DATED : December 9, 2014
INVENTOR(S) : Christopher Scott Trewin It is certified that error appears in the above-identified patent and that said Letters Patent is hereby corrected as shown below:

On the title page:

In ITEM (57) ABSTRACT, LINE 11: after "connector element able" insert --to--

In the specification:

| | | |
|---|---|---|
| COLUMN 1, | LINE 42, | change "use" to --used-- |
| COLUMN 2, | LINE 25, | change "first and second members" to --mounting member and holder member-- |
| COLUMN 3, | LINES 44-45, | change "first and second members" to --mounting member and holder member-- |
| COLUMN 3, | LINES 63-64, | change "first and second members" to --mounting member and holder member-- |

In the claims:

| | | | |
|---|---|---|---|
| CLAIM 2, | COLUMN 11, | LINE 12, | change "**1**" to --**1**,-- |
| CLAIM 11, | COLUMN 11, | LINE 43, | change "**1**" to --**1**,-- |
| CLAIM 19, | COLUMN 12, | LINE 29, | change "couplings" to --couplings,-- |
| CLAIM 19, | COLUMN 12, | LINE 32, | change "structure" to --structure,-- |
| CLAIM 19, | COLUMN 12, | LINES 32-33, | delete "and engageable with said mounting member" |
| CLAIM 19, | COLUMN 12, | LINE 38, | after "connector element able" insert --to-- |

Signed and Sealed this
Twelfth Day of May, 2015

Michelle K. Lee

Michelle K. Lee
*Director of the United States Patent and Trademark Office*